US007848842B2

(12) United States Patent
Suzuki et al.

(10) Patent No.: US 7,848,842 B2
(45) Date of Patent: Dec. 7, 2010

(54) SEWING MACHINE AND SEWING MACHINE CAPABLE OF EMBROIDERY SEWING

(75) Inventors: Hiroyuki Suzuki, Nagoya (JP); Yutaka Nomura, Nagoya (JP); Masaru Jimbo, Kasugai (JP); Yoshinori Nakamura, Toyohashi (JP); Eiichi Ito, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 928 days.

(21) Appl. No.: 11/727,110

(22) Filed: Mar. 23, 2007

(65) Prior Publication Data

US 2007/0227420 A1 Oct. 4, 2007

(30) Foreign Application Priority Data

Mar. 28, 2006 (JP) ..... 2006-087781
Jan. 23, 2007 (JP) ..... 2007-012149

(51) Int. Cl.
*G06F 7/66* (2006.01)

(52) U.S. Cl. ..... 700/136; 112/470.01; 112/475.02

(58) Field of Classification Search ..... 700/136–138; 112/102.5, 470.01, 470.03, 470.06, 475.02, 112/475.18, 475.19
See application file for complete search history.

(56) References Cited

U.S. PATENT DOCUMENTS 5,323,722 A 6/1994 Goto et al.
5,794,553 A * 8/1998 Futamura ..... 112/102.5
5,911,182 A * 6/1999 Uyama et al. ..... 112/102.5
6,324,441 B1 * 11/2001 Yamada ..... 700/138
6,980,877 B1 * 12/2005 Hagino et al. ..... 700/138
2002/0007228 A1 * 1/2002 Goldman ..... 700/138
2002/0038162 A1 * 3/2002 Yamada ..... 700/138
2004/0243275 A1 * 12/2004 Goldman ..... 700/138
2005/0283268 A1 * 12/2005 Hagino et al. ..... 700/138

FOREIGN PATENT DOCUMENTS

JP B 47-17020 5/1972
JP B2 62-19193 4/1987
JP A 2-228996 9/1990
JP U-06-031677 4/1994
JP A 6-142358 5/1994
JP B2 2583785 11/1996
JP A 11-486 1/1999
JP B2 2943444 6/1999

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

A sewing machine including a needle-swing mechanism that swings a needle bar; a cloth-feed mechanism that feeds a workpiece cloth by a feed dog; an imaging unit that captures an image of a baseline drawn on a surface of the workpiece cloth; a baseline-color detection portion that detects a baseline color of the baseline based on an image data of the baseline captured by the imaging unit; a first storage portion storing a mapping of a plurality of baseline colors to stitch data of a plurality of normal patterns; and a control portion that forms normal pattern stitches along the baseline by reading stitch data corresponding to the baseline color detected by the baseline-color detection portion from the first storage portion and controlling the needle-swing mechanism and the cloth-feed mechanism based on the stitch data read.

5 Claims, 24 Drawing Sheets

T1

| BASELINE COLOR | NORMAL PATTERN STITCH DATA |
|---|---|
| RED | STRAIGHT STITCH DATA |
| ORANGE | ZIGZAG STITCH DATA |
| YELLOW | TRIPLE STICH DATA |
| GREEN | BASTING STITCH DATA |
| BLUE | OVER CASTING STITCH DATA |
| PURPLE | BLIND STITCH DATA |
| ⋮ | ⋮ |

FIG. 5

T2

| BASELINE WIDTH (mm) | NEEDLE-SWING AMOUNT (mm) | CLOTH-FEED AMOUNT (mm) |
|---|---|---|
| 0~0.4 | 0.5 | 0.5 |
| 0.5~0.9 | 0.7 | 0.7 |
| 1.0~1.4 | 1.0 | 1.0 |
| 1.5~1.9 | 1.5 | 1.5 |
| 2.0~2.4 | 2.0 | 2.0 |
| 2.5~2.9 | 2.5 | 2.5 |
| 3.0~ | 4.0 | 4.0 |

FIG. 6

T2A

| BASELINE WIDTH (mm) | CLOTH-FEED AMOUNT (mm) |
|---|---|
| 0~0.4 | 0.2 |
| 0.5~0.9 | 0.5 |
| 1.0~1.4 | 0.7 |
| 1.5~1.9 | 1.0 |
| 2.0~2.4 | 2.0 |
| 2.5~2.9 | 3.0 |
| 3.0~ | 5.0 |

FIG.12

T4

| NEEDLE-BAR NUMBER | THREAD COLOR (BASELINE COLOR) |
|---|---|
| 1 | RED |
| 2 | ORANGE |
| 3 | YELLOW |
| 4 | GREEN |
| 5 | BLUE |
| 6 | PURPLE |

FIG. 16

T5

| BASELINE WIDTH (mm) | EMBROIDERY STITCH DATA |
|---|---|
| 0~1.0 | RUNNING STITCH |
| 1.1~5.0 | SATIN STITCH |
| 5.1~ | FILL STITCH |
| ⋮ | ⋮ |

FIG. 17

SEWING MACHINE AND SEWING MACHINE CAPABLE OF EMBROIDERY SEWING

This application is based upon and claims the benefit of priority from the prior Japanese Patent Application 2006-087781, filed on Mar. 28, 2006 and Japanese Patent Application 2007-012149 filed on Jan. 23, 2007 the entire contents of which are incorporated herein by reference.

FIELD

The present disclosure is directed to a sewing machine capable of sewing plurality types of stitches and a sewing machine capable of embroidery sewing.

BACKGROUND

Sewing machines provided with a cloth-edge detector that detects a cloth edge of a workpiece cloth have been conceived. Such sewing machines sew stitches for normal patterns such as straight stitches and zigzag stitches.

An automatically-controlled sewing machine described in JP S62-19193 B (patent document 1) includes a cloth-edge detector, a space-setting circuit, and a swing-width actuator. The cloth-edge detector is provided above a presser foot and outputs a position detection signal by detecting the cloth edge of the workpiece cloth. The space-setting circuit outputs space setting-signals based on spacing from the cloth edge to a stitch-forming baseline (reserved width). The swing-width actuator swings the needle bar based on a position detection signal. Under such configuration, the automatically-controlled sewing machine automatically forms stitches while maintaining consistent spacing from the cloth edge.

On the other hand, there has been conceived an embroidery data generating unit provided with an image reader. The embroidery data generating unit reads a color drawn on an original image by the image reader for each embroidery area, and appends embroidery data with a thread color code of the color read from each embroidery area.

An embroidery data generating unit described in JP H06-142358 A (patent document 2) reads an original image by an image scanner. Then, a color in each embroidery area is read from an image data of the original image, which was read, to determine a thread color of embroidery thread for each embroidery area. Thus, embroidery sewing operation using multiple colors can be executed without having to designate a color in stitch data for each embroidery area if the desired colors are drawn on the original image in advance.

According to the automatically-controlled sewing machine described in patent document 1, stitches can be formed along the cloth edge while maintaining consistent spacing from the cloth edge of the workpiece cloth. However, a pattern selection operation is required upon every instance of switching a stitch pattern to a straight stitch or a zigzag stitch. Also, in sewing two types of zigzag stitches having different needle-swing amount and cloth-feed amount, the user is required to change the settings for the needle-swing amount and the cloth-feed amount during the sewing operation, leading to increased complexity in the sewing work.

Furthermore, the automatically-controlled sewing machine described in patent document 1 is provided with a cloth-edge detector provided above the presser foot in close proximity of a needle drop point, thus providing poor visibility of the needle drop point. Such being the case, it is very difficult to see the actual needle drop point, thereby leading to poor sewing efficiency.

The embroidery data generating unit described in patent document 2 is configured to read the original image having the desired colors drawn thereon in advance by an image scanner to detect the color of each colored embroidery area. However, under such configuration, the type of embroidery stitch to be formed on the embroidery area cannot be changed depending on the detected color. In such case, a method may be employed in which a stitch type such as a satin stitch or a fill stitch is designated by the user upon generation of stitch data for each embroidery area. However such arrangement requires complex editing work on the part of the user.

SUMMARY

An object of the present disclosure is to provide a sewing machine and a sewing machine capable of embroidery sewing that allows automatic sewing of various types of stitches without having to execute complex operations.

A sewing machine of the present disclosure includes a needle-swing mechanism that swings a needle bar; a cloth-feed mechanism that feeds a workpiece cloth by a feed dog; an imaging unit that captures an image of a baseline drawn on a surface of the workpiece cloth; a baseline-color detection portion that detects a baseline color of the baseline based on an image data of the baseline captured by the imaging unit; a first storage portion that stores a mapping of a plurality of baseline colors to stitch data of a plurality of normal patterns; and a control portion that forms normal pattern stitches along the baseline by reading the stitch data corresponding to the baseline color detected by the baseline-color detection portion from the first storage portion and controlling the needle-swing mechanism and the cloth-feed mechanism based on the stitch data read.

Under such configuration, stitch data corresponding to the baseline color of the baseline is read based on the image data of the baseline drawn on the workpiece cloth surface. Then the needle-swing mechanism and the cloth-feed mechanism are controlled based on such stitch data and normal pattern stitches are formed along the baseline. Thus, automatic sewing can be executed with various stitches without having to execute complex operations by merely drawing colored baselines on the workpiece cloth surface.

In such case, the needle-swing mechanism and the cloth-feed mechanism may be controlled based on the needle-swing amount data and the cloth-feed amount data corresponding to the baseline-width of the captured baseline.

Also, a sewing machine capable of embroidery sewing of the present disclosure includes a carriage to which an embroidery frame retaining a workpiece cloth is attachably/detachably attached; a carriage drive mechanism that drives the carriage independently in an X-direction and a Y-direction perpendicular to the other respectively; an imaging unit that captures an image of a baseline drawn on a surface of the workpiece cloth; and a control portion that controls the carriage drive mechanism so as to form an embroidery stitch along the baseline based on the image data of the baseline captured by the imaging unit.

According to such configuration, embroidery stitches are formed along the baseline based on the image data of the baseline drawn on the workpiece cloth surface. Thus, various embroidery stitches can be formed automatically without having to execute complex operations by merely drawing various baselines on the workpiece cloth surface.

In such case, a needle bar to be used for sewing may be determined based on the baseline color of the baseline. Furthermore, the carriage drive mechanism may be controlled based on a baseline-width of the baseline.

BRIEF DESCRIPTION OF THE DRAWINGS

Other objects, features and advantages of the present disclosure will become clear upon reviewing the following description of the illustrative aspects with reference to the accompanying drawings, in which.

FIG. 5 indicates a data configuration of a baseline-color table;

FIG. 6 indicates a data configuration of a baseline-width table;

FIG. 12 corresponds to FIG. 6 illustrating a modified illustrative aspect;

FIG. 16 indicates a data configuration of a needle bar table;

FIG. 17 indicates a data configuration of a baseline-width table;

DETAILED DESCRIPTION

A first embodiment of the present disclosure is described with reference to FIGS. 1 to 12.

Figure 1:
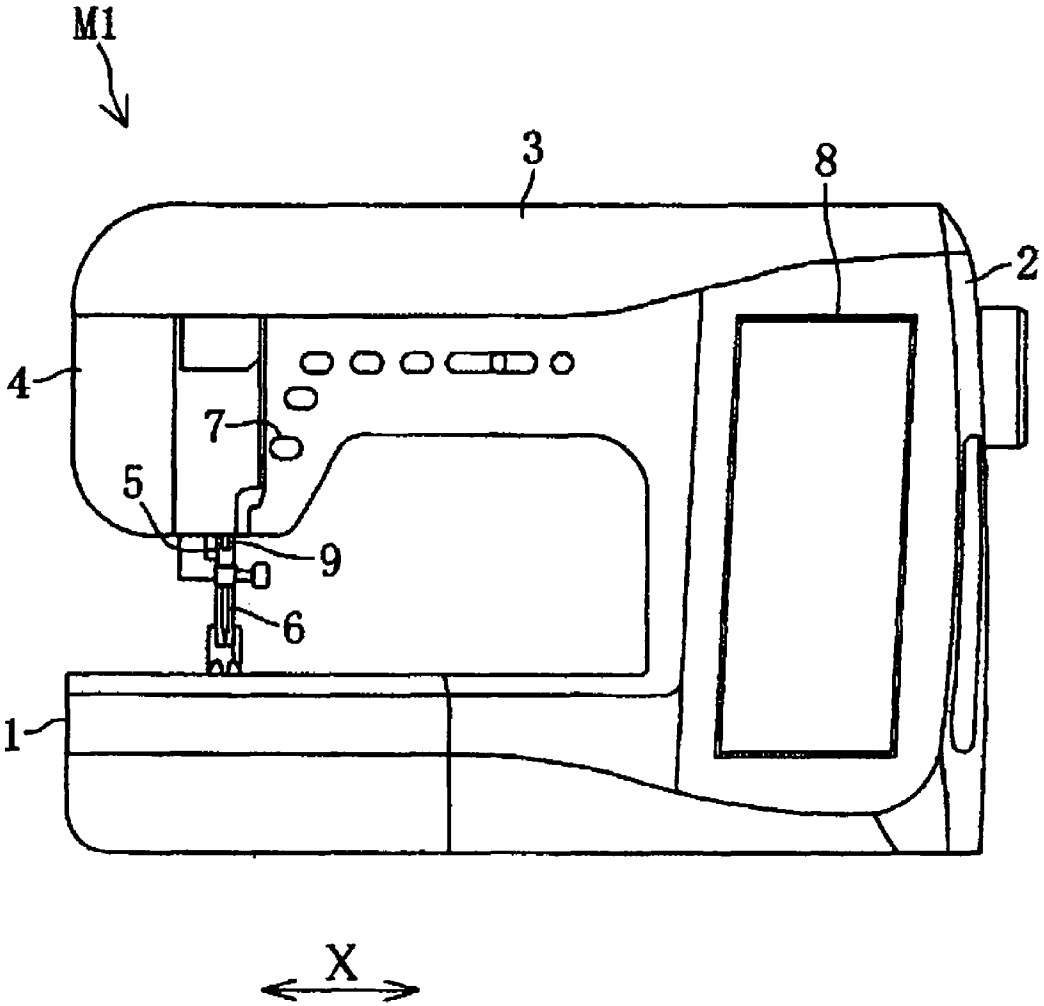
FIG. 1 is a front view of a lockstitch sewing machine in its entirety in accordance with a first illustrative aspect of the present disclosure.

Referring to FIG. 1, the lockstitch sewing machine M1 includes a bed 1, a pillar 2 standing on the right end of the bed 1, and an arm 3 extending leftward from the upper end of the pillar 2 so as to confront the bed 1.

A head 4 of the arm 3 includes a needle-bar drive mechanism and a thread take-up drive mechanism not shown. The head 4 of the arm 3 is also provided with a needle-swing mechanism 80 (refer to FIG. 3). The needle-bar drive mechanism vertically moves a needle bar 5 having a sewing needle 6 attached to the lower end thereof. The thread take-up drive mechanism vertically moves a thread take-up (not shown) in synchronization with the vertical movement of the needle bar 5. The needle-swing mechanism 80 swings the needle bar 5 in a direction perpendicular to the cloth-feed direction.

Figure 2:
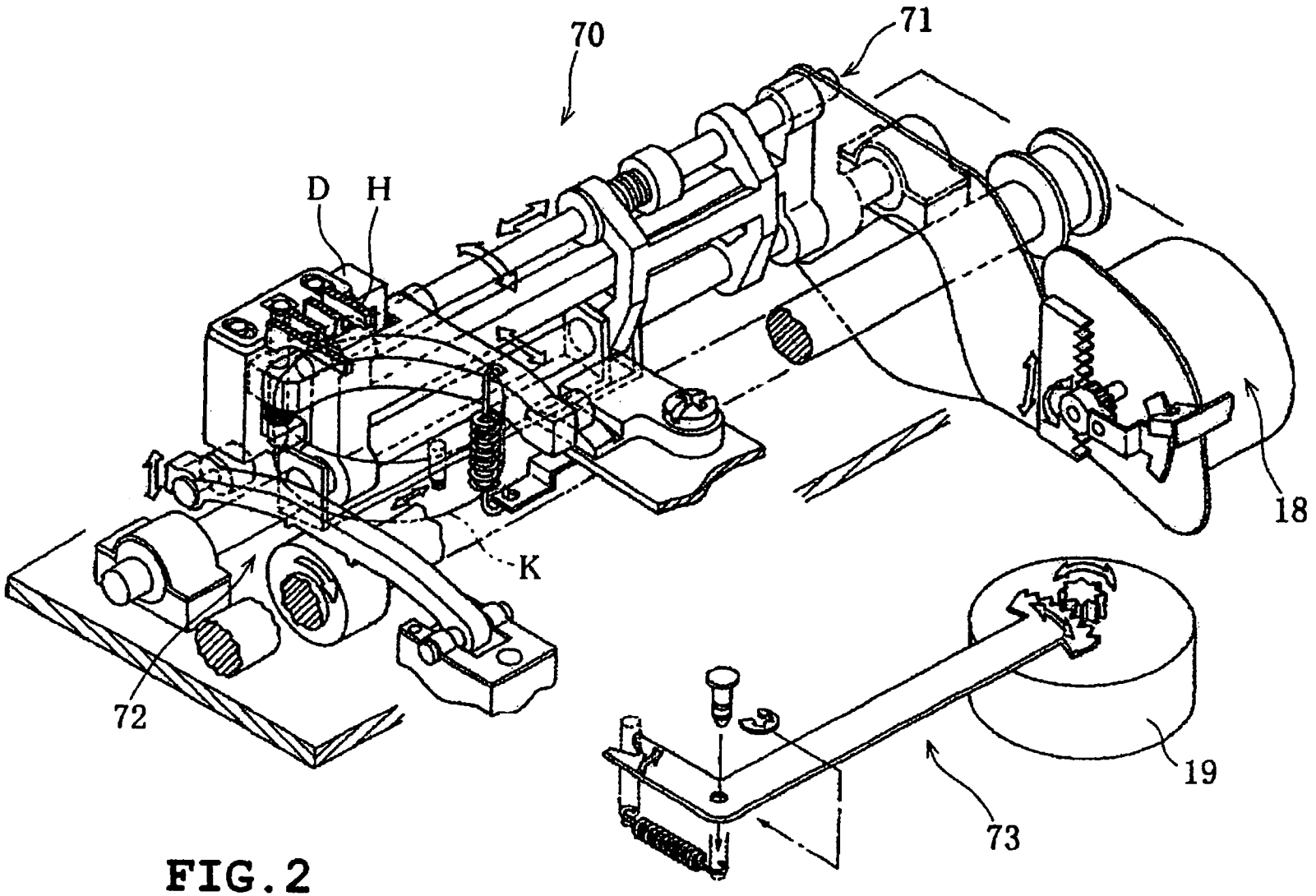
FIG. 2 is a perspective view of a cloth-feed mechanism.

Referring to FIG. 2, the bed 1 includes a feed dog longitudinally-moving mechanism 71 that longitudinally (the front and rear direction as viewed in FIG. 1) drives a feed stand D having a feed dog H secured thereto; and a feed dog vertically-moving mechanism 72 that vertically drives the feed stand D; a cloth-feed mechanism 70 provided with a lateral-feed mechanism 73 that drives the feed stand D in the lateral direction (an X-direction as viewed in FIG. 1). Also, a loop taker K containing a bobbin (not shown) and cooperating with the sewing needle 6 is provided in the bed 1. Detailed description of the cloth-feed mechanism 70 will not be given since it is the same as the cloth-feed mechanism described in JP 2952982 B.

Figure 4:
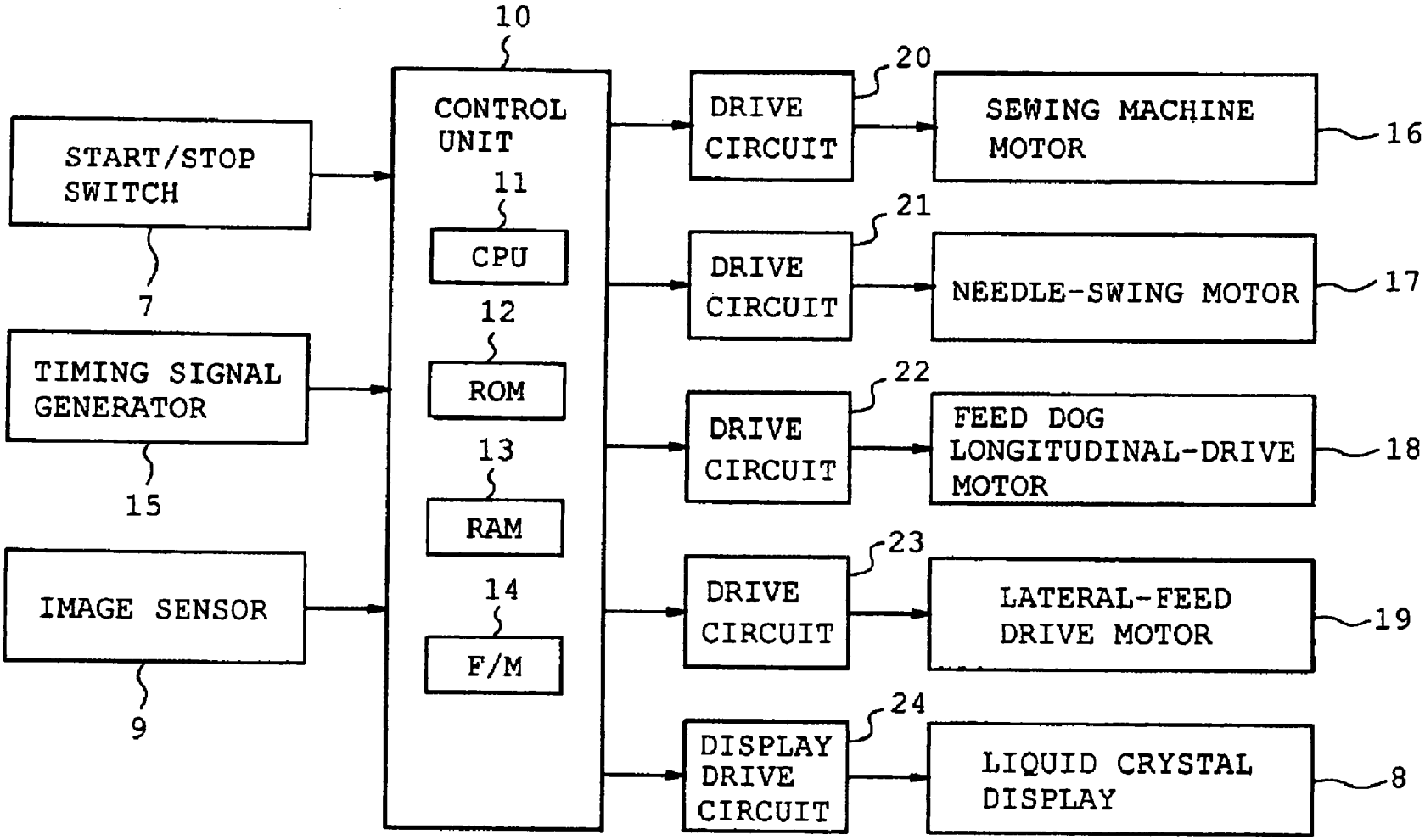
FIG. 4 is a block diagram of a control system of the lockstitch sewing machine.

The feed dog vertically-moving mechanism 72, the needle-bar drive mechanism and the thread take-up drive mechanism are respectively driven in synchronization with a sewing machine main shaft (not shown) rotated by a sewing machine motor 16 (refer to FIG. 4). As opposed to this, the needle-swing mechanism 80, the feed dog longitudinally-moving mechanism 71 and the lateral-feed mechanism 73 are driven by dedicated motors namely, needle-swing motor 17 (refer to FIG. 4), a feed dog longitudinal-drive motor 18, and a lateral feed drive motor 19. That is, a needle-swing amount of the needle bar 5 can be changed depending upon the drive amount of the needle-swing motor 17 via the needle-swing mechanism 80. A cloth-feed amount of the feed dog can be changed depending upon the drive amount of the feed dog longitudinal-drive motor 18 and the lateral-feed drive motor 19 via the feed dog longitudinally-moving mechanism 71 and the lateral-feed mechanism 73.

Next, a description will be given on the needle swing mechanism 80 with reference to FIG. 3. A vertically-oriented needle-bar support 81 is disposed in the substantial central portion of the head 4. The upper end of the needle-bar support 81 is pivoted to a frame (not shown) inside the head 4 by a pivot pin 82, whereby the needle-bar support 81 is rendered swingable relative to the frame. Also, the lower end of the needle-bar support 81 is biased in a direction of arrow F in FIG. 3 by a spring not shown. A needle-swing lever 83 is pivoted rotatably to the frame by a rotary shaft 84 and a lower end 83*b* of the needle-swing lever 83 is in abutment with the side surface of a lower end 81*a* of the needle-bar support 81.

Figure 3:
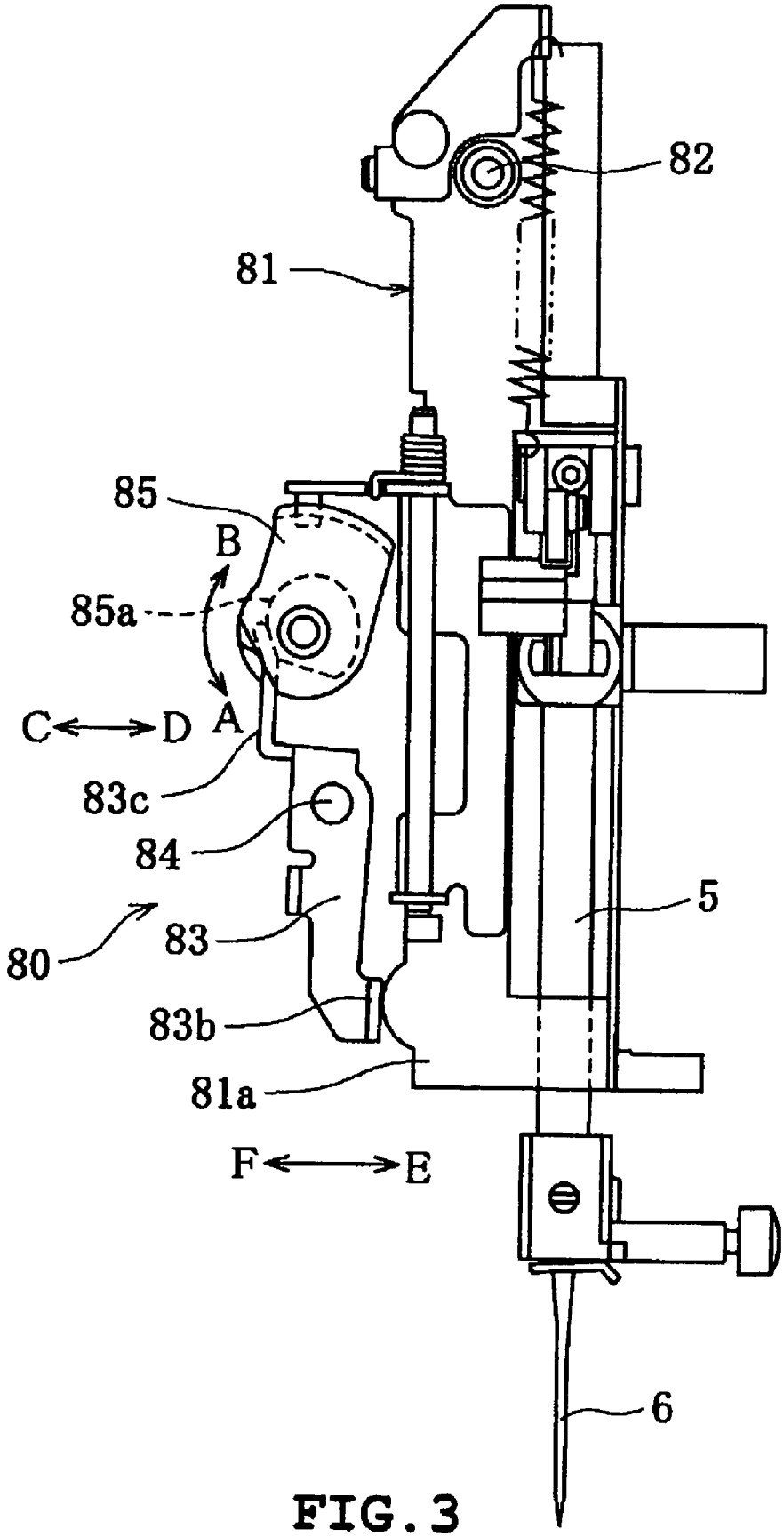
FIG. 3 is a front view of a needle-swing mechanism.

When a cam 85 is rotated in a direction of arrow A in FIG. 3 by the needle-swing motor 17 (refer to FIG. 4), a cam portion 85*a* of the cam 85 presses an abutting portion 83*c* of the needle-swing lever 83 in a direction of arrow C in FIG. 3, whereby the needle-swing lever 83 is rotated in a direction of arrow E in FIG. 3. Thus, the needle-bar support 81 is pressed in the direction of arrow E in FIG. 3 resisting the biasing force of the spring. Conversely, when the cam portion 85*a* is rotated in a direction of arrow B in FIG. 3, the abutting portion 83*c* of the needle-swing lever 83 is reverted in a direction of arrow D of FIG. 3 and the needle-bar support 81 is moved in a direction of arrow F in FIG. 3. The above described configuration of the needle-swing mechanism 80 allows swinging of the needle bar 5 and the sewing needle 6.

Referring to FIG. 1, provided in the front face of the arm 3 is a liquid crystal display 8 capable of displaying color images. The liquid crystal display 8 displays various stitch patterns (normal patterns), various function names, pattern names, and various messages, and the like. Touch keys (not shown) composed of transparent electrodes are provided in the front face of the liquid crystal display 8 and pattern selection of the patterns to be sewn and selection of functions to be executed are rendered by operating the applicable touch keys.

Provided in the underside of the head 4, more specifically in the portion forward relative to the needle bar 5 is a downwardly oriented image sensor 9 capable of capturing color images. The image sensor 9 is configured by a CCD (charge coupled device) imaging element and captures images of a workpiece cloth W1 placed on the upper surface of the bed 1 from a substantially upward direction. When the workpiece cloth W1 to be sewn is placed on the upper surface of the bed 1, the image sensor 9 captures an image of a substantially rectangular imaging range (refer to FIG. 10) in front of the sewing needle 6. The workpiece cloth W1 and various baselines 26 drawn on the surface of the workpiece cloth W1 are captured in the imaging range.

Next, a description will be given on a control system of a lockstitch sewing machine M1.

As shown in FIG. 4, the control unit 10 includes a computer including a CPU 11, a ROM 12, a RAM 13 and an electrically programmable non-volatile flash memory (F/M) 14.

The control unit 10 has connected thereto a start/stop switch 7, a timing signal generator 15 that detects a rotational position of the sewing machine main shaft and the image sensor 9. The control unit 10 also has connected thereto a drive circuit 20 for the sewing machine motor 16; a drive circuit 21 for the needle-swing motor 17; a drive circuit 22 for a feed dog longitudinal-drive motor 18; a drive circuit 23 for a lateral-feed drive motor 19; and a display drive circuit 24 for a liquid crystal display 8.

The ROM 12 has preinstalled therein a sewing control program for sewing various normal patterns, control programs for display control in general; and a control program for a later described baseline trace sewing control. Areas for providing flags, pointers, counters, registers, and buffers, and the like, are allocated in the RAM 13 as required.

The flash memory 14 stores a baseline-color table T1 indicated in FIG. 5. The baseline-color table T1 associates a color code (red, orange, yellow, and green) of the baseline color with stitch data for normal patterns (stitch data for a straight stitch, stitch data for a zigzag stitch, stitch data for a triple stitch, stitch data for a basting stitch). The stitch data is initialized with needle-swing amount and cloth-feed amount that are optimized for each pattern.

Furthermore, the flash memory 14 stores data contained in a baseline-width table T2 indicated in FIG. 6. The baseline-width table T2 associates baseline width (such as [0 to 0.4], [0.5 to 0.9], [1.0 to 1.4], and [1.5 to 1.9]) with needle-swing amount data (such as 0.5, 0.7, 1.0, and 1.5) and cloth-feed amount data (such as 0.5, 0.7, 1.0, and 1.5).

Figure 7:
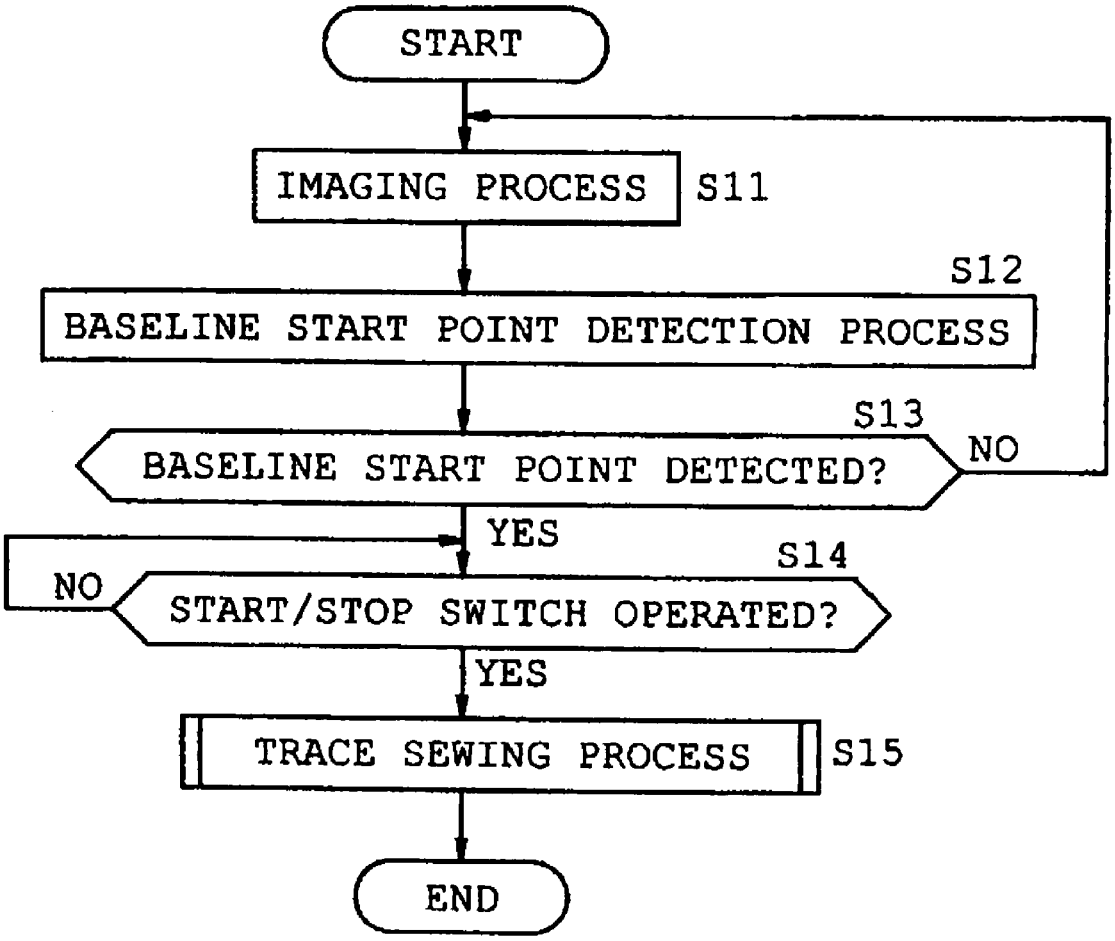
FIG. 7 is a flowchart of a baseline trace sewing control.

Next, a baseline-trace sewing control for normal patterns executed by the control unit 10 of the lockstitch sewing machine M1 will be described based on the flowcharts indicated in FIGS. 7 and 8. Reference symbols Si (i=11, 12, 13 . . . ) indicate each step number.

The control unit 10 starts the control when power is supplied to the lockstitch swing machine M1. First, an imaging process is executed (step S1) by the image sensor 9. In the imaging process, the control unit 10 captures an image of the workpiece cloth W1 and the baseline 26 within the imaging range forward relative to the sewing needle 6. When the imaging process is terminated, the control unit 10 proceeds to step S12 and executes a start point detection process of the baseline 26. In the start point detection process, the control unit 10 detects the baseline 26 drawn on the surface of the workpiece W1 and a start point 26*s* of the baseline 26 (refer to FIG. 9) based on the captured image data. When the start point detection process is terminated, the control unit 10 proceeds to step S13 and judges whether or not the baseline 26 and the stating point 26*s* of the baseline 26 has been detected. For example, in case the baseline 26 and the start point 26*s* of the baseline 26 have not been detected (NO) in cases where no workpiece cloth W1 is placed on the upper surface of the bed 1; or in case the drawn baseline 26 has not been detected in spite of the workpiece cloth W1 having been placed on the upper surfaced of the bed 1; the control unit 10 repeats steps S11 to S13.

In the above step 12, first, the control unit 10 executes a binarizing process of the image data by using a "threshold value" capable of detecting the baseline 26. Next, the control unit 10 executes noise cancellation of the image data and thereafter executes an outline extraction process to obtain an outline of the baseline 26. Then, the control unit 10 detects a terminating end of the obtained outline of the baseline 26 which is closer to the sewing needle 6 as the start point 26*s*.

When the user places the workpiece cloth W1 having the baseline 26 drawn thereon on the upper surface of the bed 1 in close proximity of the sewing needle 6, and in case the baseline 26 and the start point 26*s* of the baseline 26 have been detected, the control unit 10 makes a "YES" judgment in step S13 and displays a message that reads "sewing can be started" on the liquid crystal display 8, for example. Then, the control unit 10 proceeds to step S14 and judges whether or not the start/stop switch 7 has been operated. If the start/stop switch 7 has been operated by the user (YES), the control unit 10 proceeds to step S15, and executes a trace sewing process (refer to FIG. 8).

Figure 8:
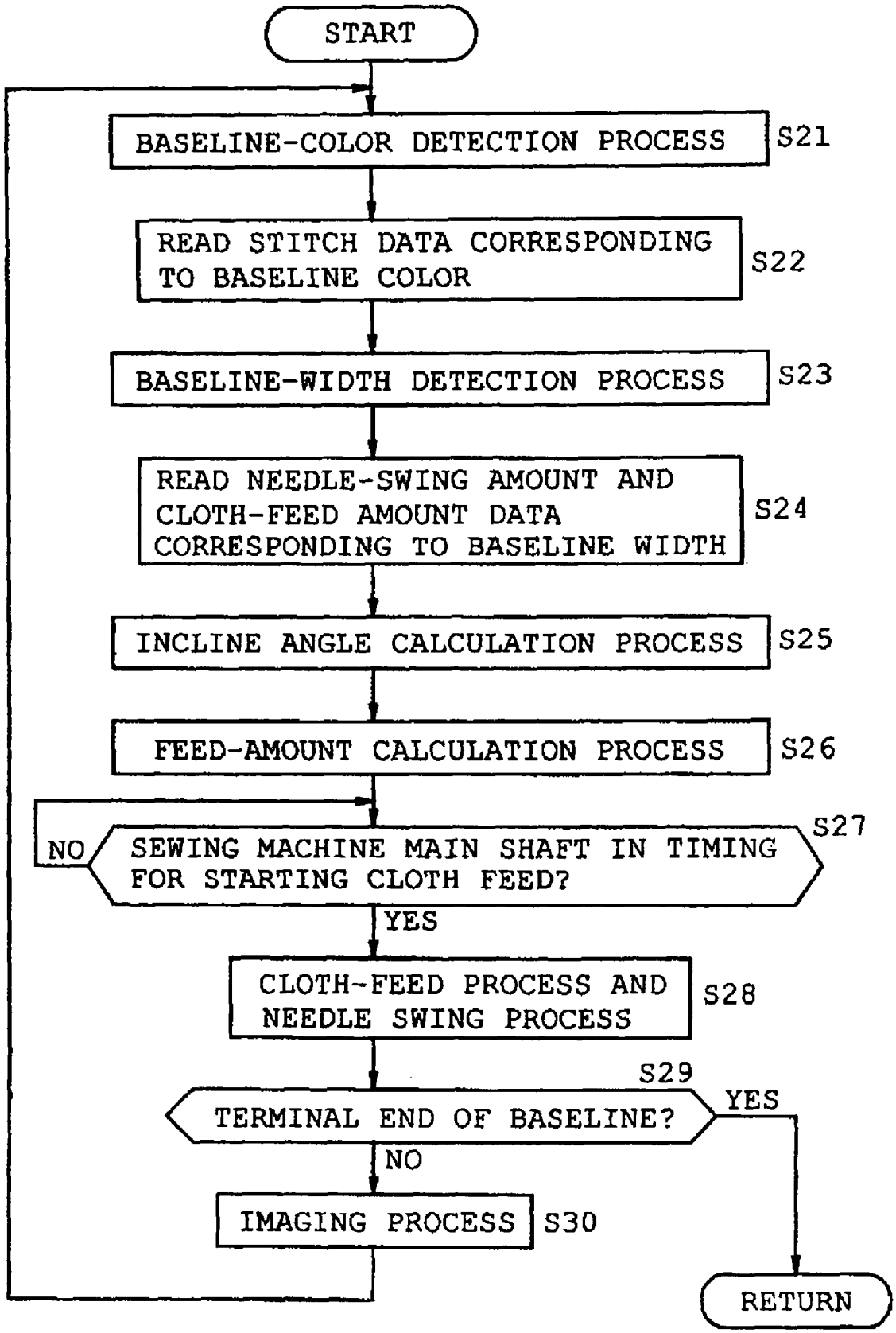
FIG. 8 is a flowchart of a trace sewing process.

As shown in FIG. 8, when the control unit 10 starts the trace sewing process, first, the baseline-color detection process is executed (step S21). In the baseline-color detection process, the control unit 10 detects the baseline color of the baseline 26 drawn on the workpiece cloth W1 based on the image data obtained in the above step S11. Next, the control unit 10 proceeds to step S22 and reads normal pattern stitch data corresponding to the detected baseline color based on the baseline-color table T1. Next, the control unit 10 proceeds to step S23 and executes a baseline-width detection process. In the baseline-width detection process, the control unit 10 detects the baseline width of the baseline 26 drawn on the workpiece cloth W1 based on the image data obtained in the above step S11.

Figure 10:
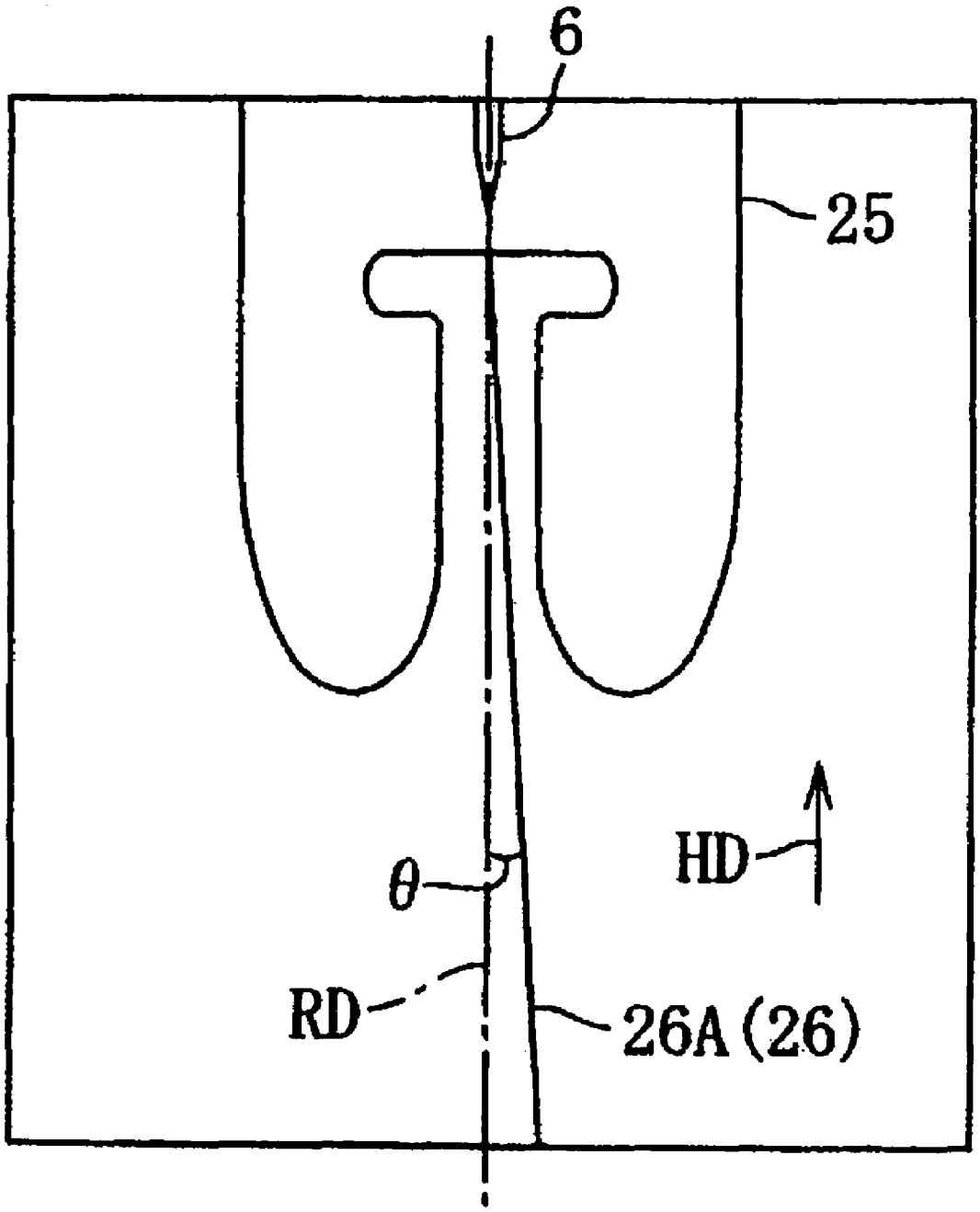
FIG. 10 illustrates a captured image data.

When the baseline-width detection process is terminated, the control unit 10 reads (step S24) the needle-swing amount data and the cloth-feed amount data of normal patterns corresponding to the detected baseline-width based on the baseline-width table T2. Next, the control unit 10 proceeds to step S25 and executes an incline angle calculation process. Referring to FIG. 10 illustrating the range of image captured by the image sensor 9, a virtual line RD indicates a line of straight stitches formed when only the feed dog longitudinal-moving mechanism 71 is driven and the workpiece cloth W1 is fed rearward (in the direction of arrow HD in FIG. 10) with the lateral position of the needle bar 5 at a middle baseline. The virtual line RD is set at a predetermined position with respect to the imaging range captured by the image sensor 9. In the incline angle calculation process, the control unit 10 calculates angle θ (displacement angle) indicating the angle of incline of the baseline 26 relative to the virtual line RD.

Next, the control unit 10 proceeds to step S26 and executes a feed-amount calculation process. In the feed-amount calculation process, the control unit 10 determines, by calculation, a longitudinal-direction feed amount and a lateral-direction feed amount of the feed dog H based on the angle θ calculated in step S25 and the cloth-feed amount read in step S24. Next, the control unit 10 proceeds to step S27 and judges whether or not the sewing machine main shaft is in a timing for starting cloth feed based on a rotational position signal of the sewing machine main shaft outputted from the timing signal generator. If the sewing machine main shaft is not in the timing for starting cloth feed (No), the control unit 10 repeats step S27.

When the sewing machine main shaft reaches the timing to start cloth feed (YES in step 27), the control unit 10 proceeds to step S28 and executes the cloth-feed process and the needle-swing process. In the cloth-feed process and the needle-swing process, the control unit 10 drives the needle-swing motor 17, the feed dog longitudinal-drive motor 18, and the lateral-feed drive motor 19 based on the needle-swing amount read in the above described step S24 and the feed-amount in the longitudinal and the lateral directions respectively determined in the above described step S26.

Next, the control unit 10 proceeds to step S29 and judges whether or not the terminal end of the baseline 26 has been captured in the image data obtained in the above described step S11. In case the terminal end of the baseline 26 has not been captured, in other words, in case the baseline 26 continues to the front side of the sewing needle 6 (No), the control unit 10 proceeds to step S30 and captures the image of the baseline 26 after sewing a single stitch (corresponding to a single vertical reciprocation of the sewing needle 6). Thereafter, processing of steps S21 onwards is repeated. In step S29, in case the terminal end of the baseline 26 is captured, in other words, in case no baseline 26 is detected in the front side of the sewing needle 6 (YES), the control unit 10 terminates the trace sewing process and also terminates the baseline-trace sewing control.

Next, a description will be given on the operation of the baseline-trace sewing control.

Figure 9:
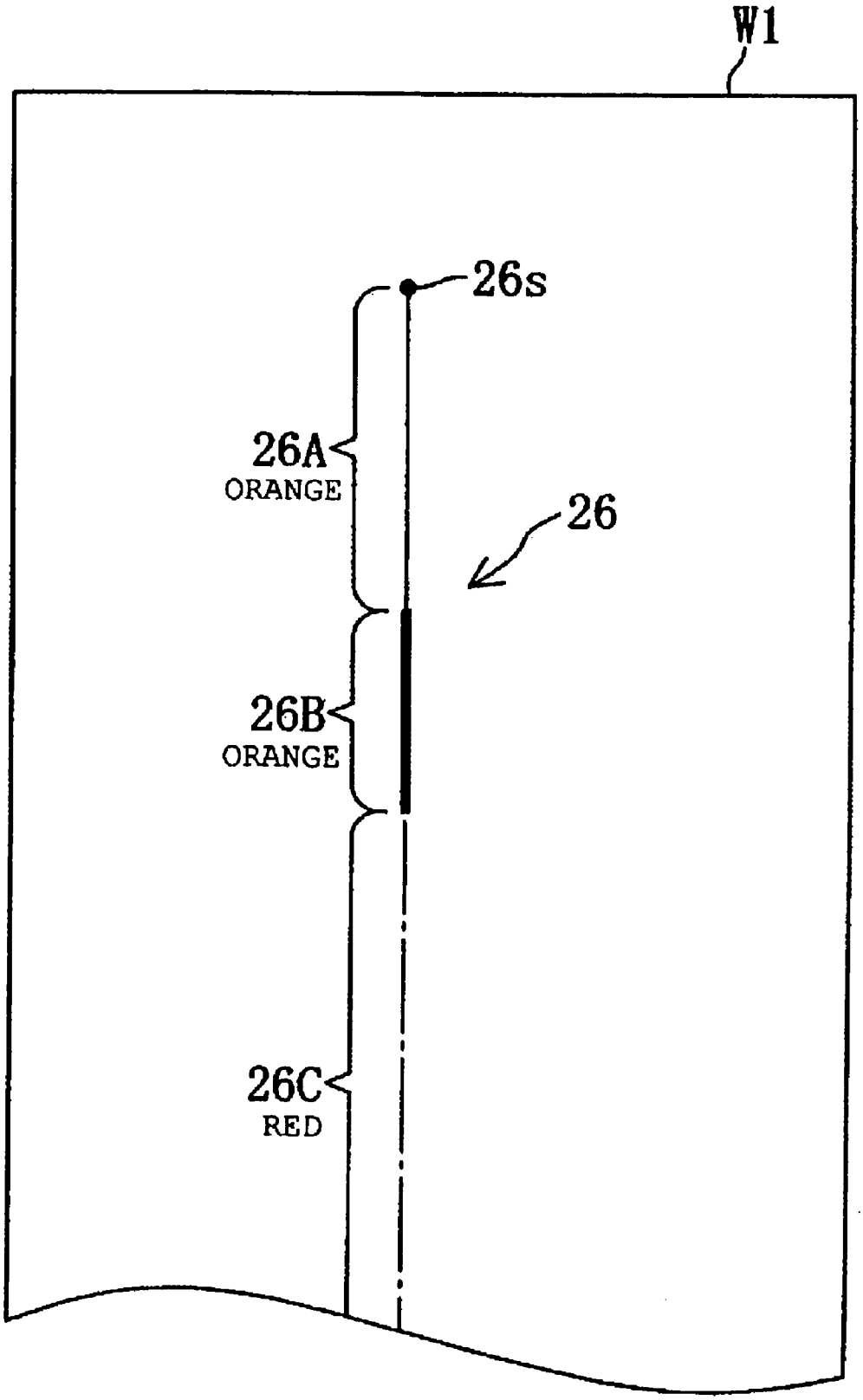
FIG. 9 is a plan view of a workpiece cloth having a baseline drawn thereto.

FIG. 9 shows the baseline 26 drawn on the workpiece cloth W1 by the user with a chalk pen erasable by an eraser. In this case, a first baseline 26A in "orange" and having a line width of "0.6 mm"; a second baseline 26B in "orange" and having a line width of "2.3 mm"; and a third baseline 26C in "red" and having a line width of "0.4 mm" are drawn in a continuous manner.

When such workpiece cloth W1 is placed on the sewing position of the bed 1 by the user, the image data illustrated in FIG. 10 is obtained by the image sensor 9. The image data includes a transparent cloth presser 25, a lower end of the sewing needle 6, and at least a portion of the first baseline 26A.

Next, when sewing is started, the imaging process is executed upon every completion of forming a single stitch. Thus, the baseline color and the baseline width of the baseline 26 are detected based on the latest image data every time a single stitch is formed. When the baseline color is detected, stitch data of normal stitch pattern corresponding to the baseline color is read and the needle-swing amount and the cloth-feed amount corresponding to the baseline width are read respectively.

Figure 11:
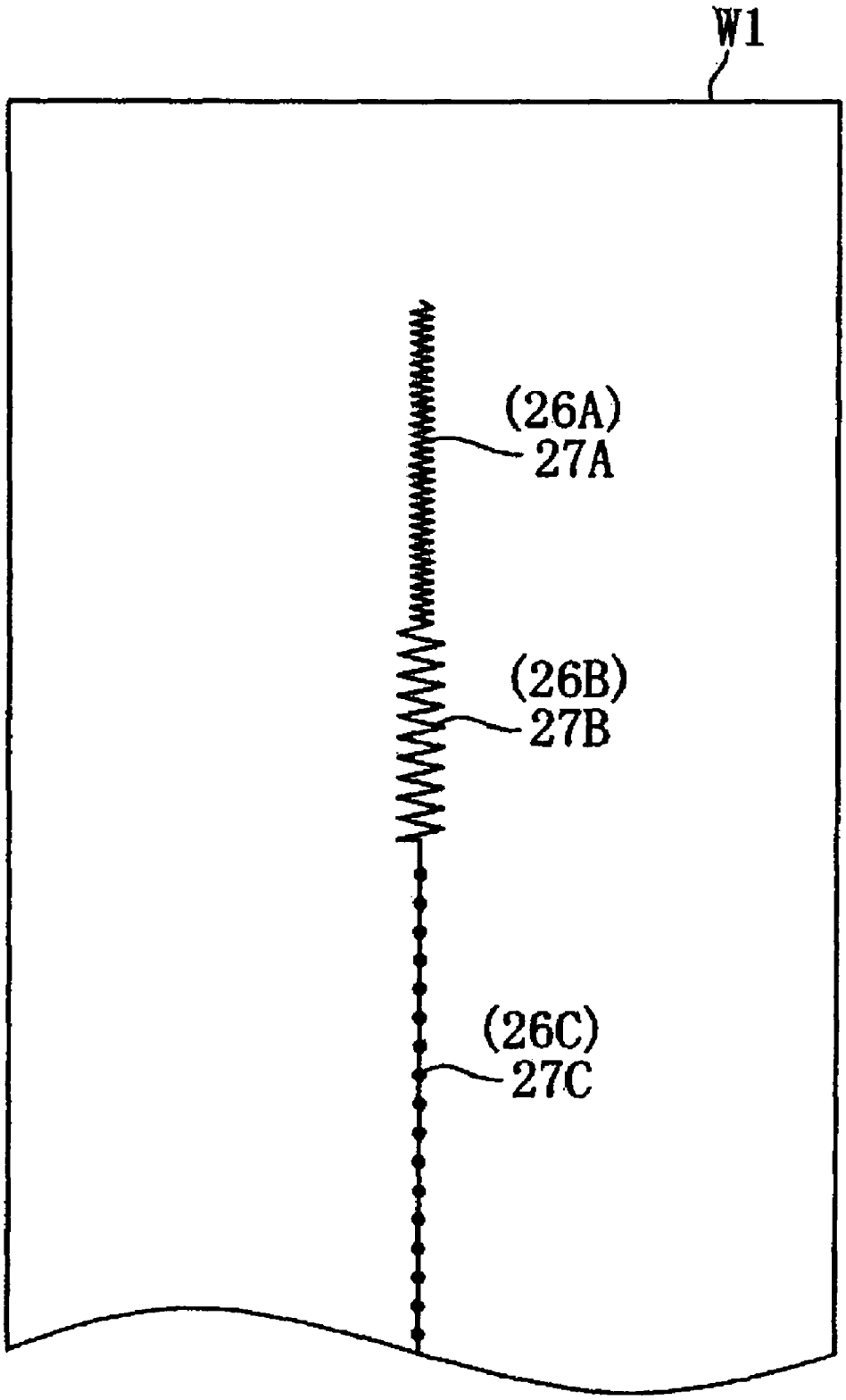
FIG. 11 is a plan view of a workpiece cloth having a normal pattern corresponding to the baseline sewn thereto.

At the timing for starting cloth feed, the needle bar 5 is swung based on the needle-swing amount data read, and the workpiece cloth W1 is fed by the feed dog H based on the cloth-feed amount data read. As a result, stitches illustrated in FIG. 11 are formed. In this case, a first zigzag stitch 27A having a needle-swing amount and a cloth-feed amount of "0.7 mm" respectively is formed so as to cover the entire first baseline 26A, and a second zigzag stitch 27B having a needle-swing amount and a cloth-feed amount of "2.0 mm" respectively is formed so as to cover the entire second baseline 26B.

Further, a straight stitch 27C having a cloth-feed amount of "0.5 mm" is formed over the third baseline 26C. For instance, in executing a "straight stitch" having a "red" baseline, only the cloth-feed amount data is required from the baseline-width table T2. Thus, in straight stitch sewing, a dedicated baseline-width table T2A may be provided that is only specified with the cloth-feed amount corresponding to the baseline width as shown in FIG. 12.

As described above, according to the present embodiment, the lockstitch sewing machine M1 includes a needle-swing mechanism 80 that swings a needle bar 5; a cloth-feed mechanism 70 that executes cloth feed in a longitudinal and a lateral direction by a feed dog H; a control unit 10 that controls the needle-swing mechanism 80 and the cloth-feed mechanism 70; an image sensor 9; and a baseline-color table T1. Under such configuration, a baseline color of a baseline 26 is detected based on an image data captured by the image sensor 9 and stitch data corresponding to the detected baseline color is read from the baseline-color table T1 whereafter the needle-swing mechanism 80 and the cloth-feed mechanism 70 are controlled to form a normal pattern stitch. Thus, the user is only required to draw a colored baseline 26 on a surface of the workpiece cloth W1 to allow automatic formation of various normal pattern stitches associated with a baseline color in advance along the baseline 26 for each baseline color of the colored baseline 26.

Thus, even an inexperienced user can do without complex pattern selection operations for switching between patterns such as straight stitches and zigzag stitches during the sewing operation by merely drawing various baselines 26 on the surface of the workpiece cloth W1 while changing the baseline color as required. Thus, the user is allowed to readily create sewing products including abundant varieties of normal stitches just like an experienced sewer.

Also, a baseline-width detection step (step S23) has been introduced that detects the baseline-width of the baseline 26 based on the image data of the baseline 26 captured by the image sensor 9; and a baseline-width table T2 has been provided that stores a mapping of a plurality of baseline-widths and their corresponding needle-swing amount of the needle bar 5 and cloth-feed amount of the feed dog. The control unit 10 controls the needle-swing mechanism 80 and the cloth-feed mechanism 70 by reading the needle-swing amount data and the cloth-feed amount data corresponding to the baseline width detected in the baseline-width detection step (step S23). Thus, various stitches associated with predetermined baseline widths and having different needle-swing amount and cloth-feed amount can be sewn automatically for each baseline 26 having different baseline width by merely drawing various baselines 26 having different baseline width on the surface of the workpiece cloth W1.

Thus, even an inexperienced user can do without complex operations of modifying settings for needle-swing amount or cloth-feed amount during the sewing operation by merely drawing various baselines 26 on a surface of the workpiece cloth W1 while changing the baseline width as required, thereby simplifying the sewing work and improving work efficiency. The user is allowed to readily create sewing products including abundant varieties of normal stitches just like an experienced sewer.

Furthermore, since the imaging sensor 9 is composed of a CCD image sensor, high-quality image data can be readily captured in a low-cost configuration. Also, the image sensor 9, being compact in size, can be readily mounted in a position distant from the needle drop point where it does affect the sewing work without interfering with other parts. One example of such position is the underside of the arm 3. Thus, the sewer is allowed to secure clear visibility of the actual needle drop point, thus being free from contacting his/her fingers against image sensor 9 when replacing the sewing needle 6, etc.

Next, a description will be given on partial modifications of the present embodiment.

In step S23 of the trace sewing process indicated in FIG. 8, in case the detected baseline width exceeds the maximum needle-swing amount, a warning message may be displayed on the liquid crystal display 8. Also, in case the sewing machine motor 16 is in rotation, a warning message may be displayed in the liquid crystal display 8 after altering the rotation of the sewing machine motor 16 to a low-speed rotation or stopping the same.

Instead of the cloth presser 25 composed of a transparent material in the above described embodiment, a cloth presser 25 made of metal may be employed. In such case, the image of the baseline 26 in close proximity of the sewing needle 6 may be captured through a slit defined forward relative to the needle through-hole of the cloth presser 25.

Next, a description on a second embodiment of the present disclosure will be given based on FIGS. 13 to 25.

Figure 13:
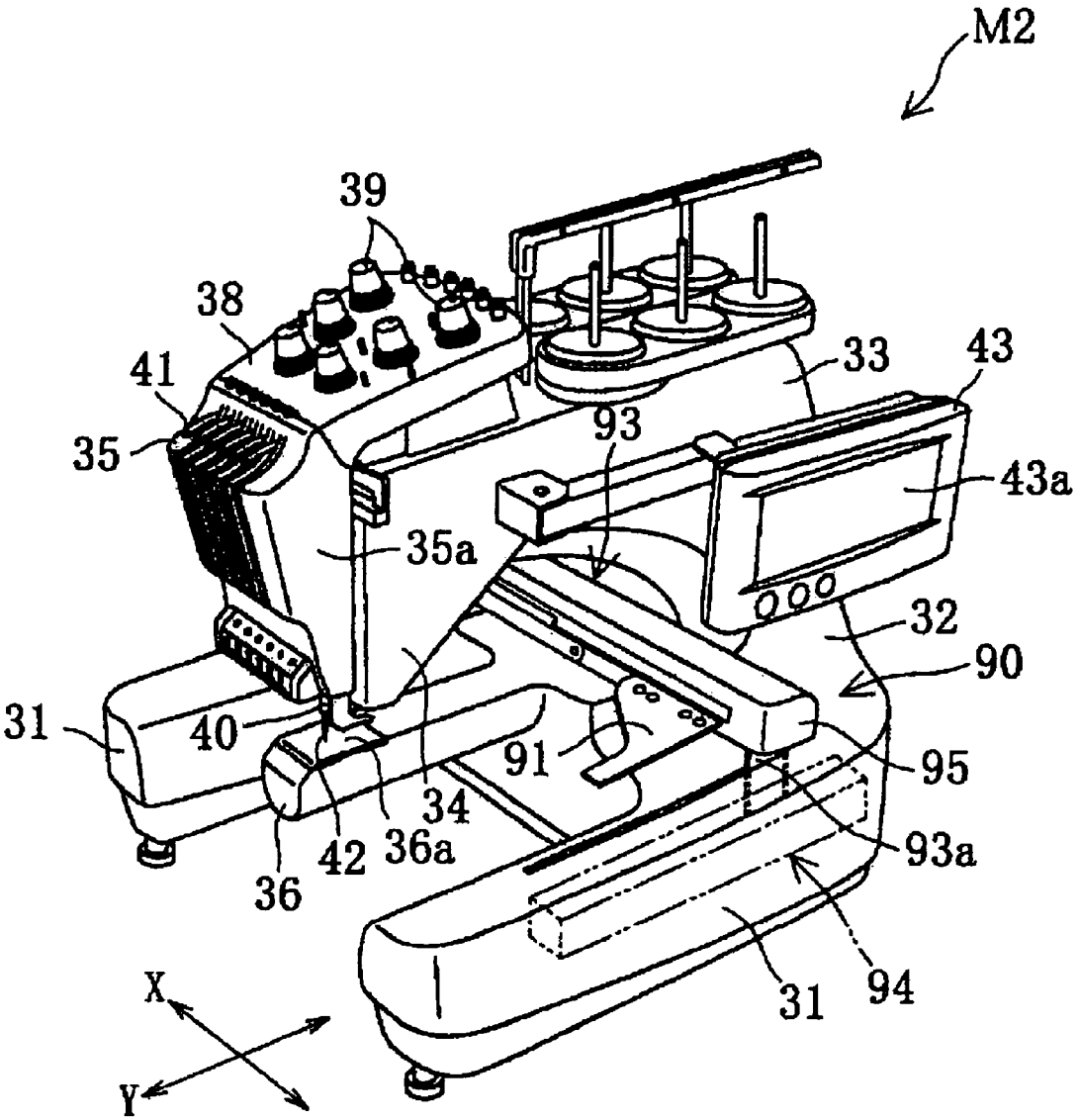
FIG. 13 is a perspective view of a sewing machine capable of embroidery sewing in its entirety in accordance with a second illustrative aspect of the present disclosure.

Referring to FIG. 13, a multi-needle embroidery sewing machine M2 capable of embroidery sewing includes a pair of left and right support legs 31; a pillar 32 standing from the rear ends of the support legs 31; an arm 33 extending forward from the upper end of the pillar 32; a needle-bar switch mechanism 35 disposed in a head 34 at the distal end of the arm 33; a cylinder bed 36 extending forward from the lower end of the pillar 32; and an embroidery frame drive mechanism 90. The needle-bar switch mechanism 35 moves the needle-bar case 35*a* in the lateral direction. The embroidery frame drive mechanism 90 moves the embroidery frame 46 (refer to FIG. 14) in an X-direction and a Y-direction perpendicular to the X-direction. Only a brief explanation will be given on the embroidery frame drive mechanism 90 since it is a well-known mechanism.

Figure 14:
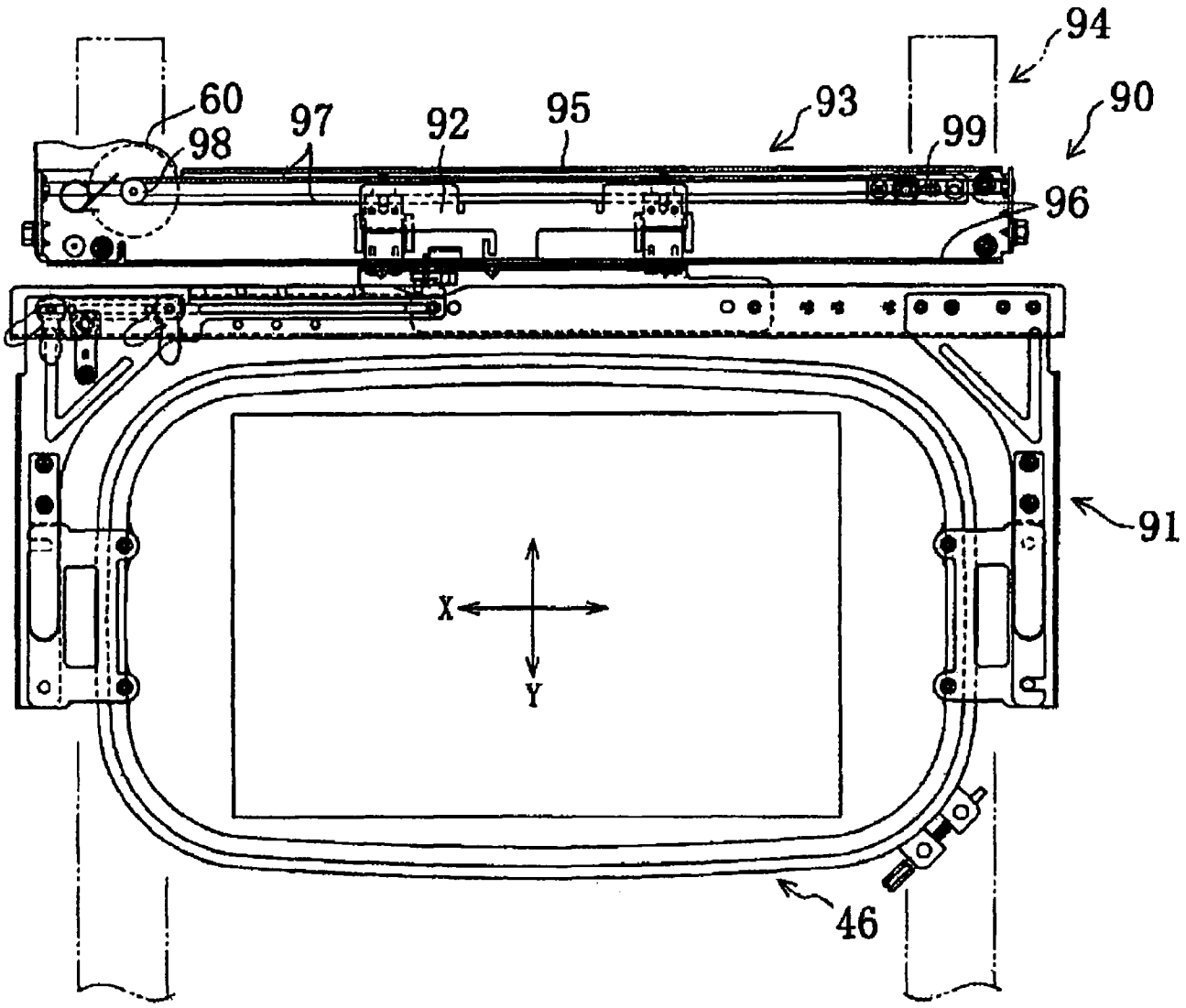
FIG. 14 is plan view of a cloth-retaining frame and a carriage drive mechanism.

Referring to FIGS. 13 and 14, the embroidery frame drive mechanism 90 includes a carriage 92 provided with a frame holder 91 having an embroidery frame 46 attachably/detachably attached thereto; an X-carriage drive mechanism 93 that moves the carriage 92 in the X-direction; a Y-carriage drive mechanism 94 that moves the carriage 92 in the Y-direction.

The X-carriage drive mechanism 93 is contained inside a laterally (X-direction) elongate movable case 95 disposed above the support legs 31. The X-carriage drive mechanism 93 supports the carriage 92 directly and moves the same in the X-direction. The X-carriage drive mechanism 93 includes a guide portion 96 that guides the carriage 92 movably in the X-direction; an X-shaft drive motor 60 composed of a step motor and an endless (looped) timing belt 97 that transmits drive force of the X-shaft drive motor 60 to the carriage 92. The timing belt 97 is wound on two pulleys 98 and 99 and is connected to the carriage 92. The pulley 98 is rotated by the X-shaft drive motor 60.

The Y-carriage drive mechanism 94 is contained inside the support legs 31, and is moved in the Y-direction along with the carriage 92 together supporting the X-carriage drive mechanism 93 and the movable case 95. The Y-carriage drive mechanism 94 includes a pair of guide portions that guides a pair of left and right legs 93*a* extending downward from the frame of the X-carriage drive mechanism 93; a Y-shaft drive motor 61 (refer to FIG. 15) composed of a step motor; a pair of endless timing belts (not shown) that transmits the drive force of the Y-shaft drive motor 61 to the pair of legs 93*a*. The pair of timing belts are wound on two pulleys (not shown) respectively and the pair of legs 93*a*. One of each pair of pulleys is driven by the Y-shaft drive motor 61.

The needle bar case 35*a* of the needle bar switch mechanism 35 includes six vertically-oriented needle bars 40; six thread take-ups 41 swingably attached at positions corresponding to each of the needle bars 40; and a presser foot (not shown) provided so as to be associated with the sewing needle 42 attached to the lower end of each needle bar 40.

The needle bar case 35*a* further includes a needle-bar drive mechanism (not shown) that transmits vertically-oriented drive force to one of the six needle bars 40. Also, a thread tension support 38 is provided integrally on the upper end of the needle bar case 35*a* that covers the needle bar switch mechanism 35 and the thread tension support 38 has six thread tension mechanisms provided thereto.

In replacing the embroidery thread, the needle-bar case 35*a* is laterally moved by the needle-bar changing motor 58 and either one of the sewing needles 42 is switched to a sewing position confronting a needle through-hole (not shown) of a needle plate 36*a* provided in the distal end of the cylinder bed 36. Then, the drive force of a sewing machine motor 57 is transmitted to the needle-bar drive mechanism via the sewing machine main shaft (not shown) and the selected needle bar 40 is vertically moved by the needle-bar drive mechanism. Stitches are formed on the workpiece cloth W2 by the cooperation of the sewing needle 42 and a rotary shuttle (not shown) disposed inside the cylinder bed 36 below the needle plate 36*a*.

The arm 33 has a foldable operation panel 43 provided thereto. The operation panel 43 includes a display 43*a*, a touch panel 43*b* (refer to FIG. 15) provided in the front face of the display 43*a*, and a plurality of operation switches. Provided inside the front end of the cylinder bed 36 is a thread cut mechanism (not shown) that cuts the needle thread and the bobbin thread.

The arm 33 has an image sensor 44 (refer to FIG. 15) capable of capturing color images disposed in the underside of the portion close to the head 34. The image sensor 44 is configured by a CCD (charge coupled device) imaging element and captures the image of the embroidery frame 46 and the workpiece cloth W2 retained thereby from a substantially upward direction. The image sensor 44 captures the image of the entire embroidery frame 46 in one go with the embroidery frame 46 attached to the carriage 37. The image sensor 44 is also capable of capturing the image of the workpiece cloth W2 retained by the embroidery frame 46 and a baseline 68 drawn on the surface of the workpiece cloth W2.

Figure 15:
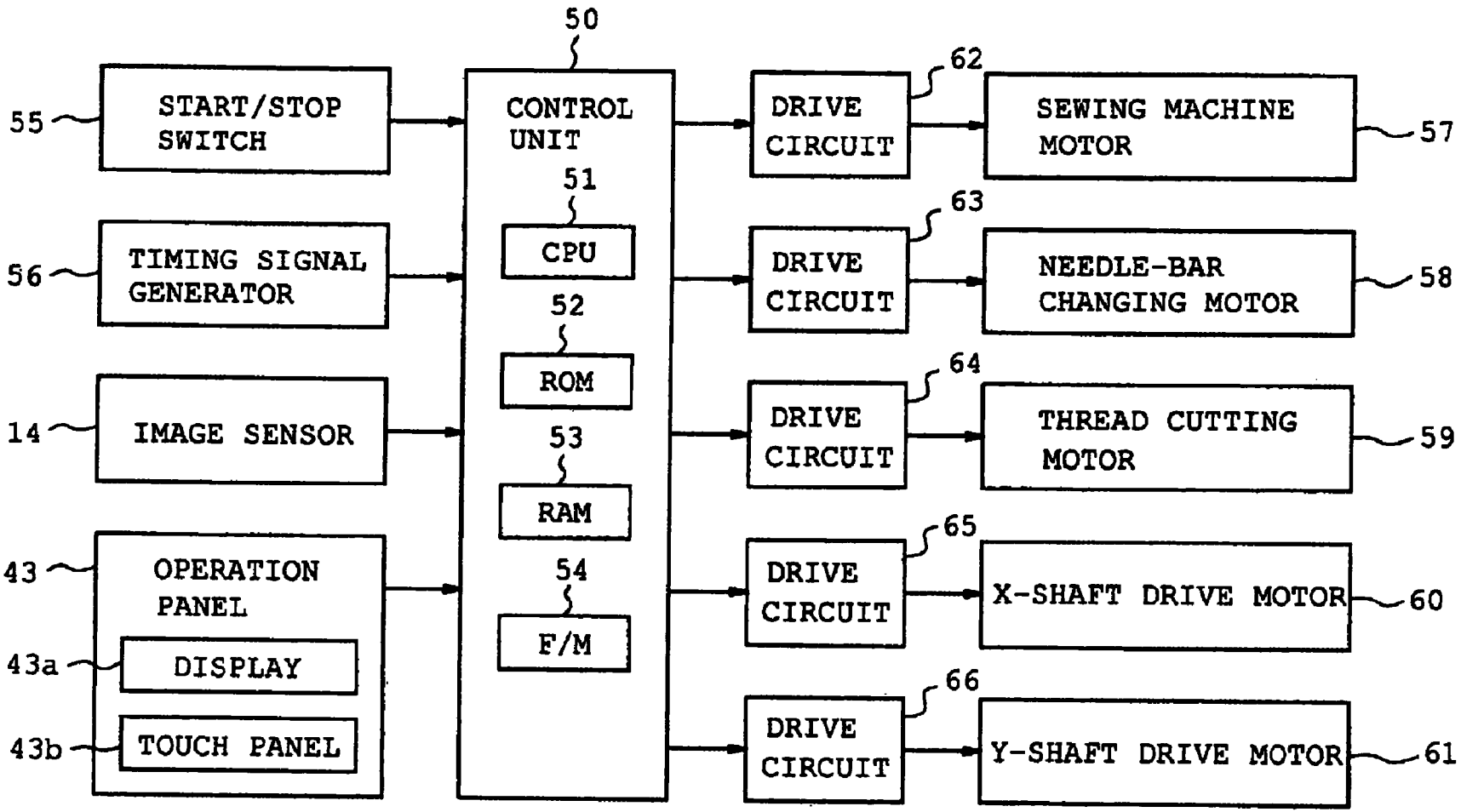
FIG. 15 is a block diagram of a control system of the sewing machine capable of embroidery sewing.

Next, a description will be given on a control system of the embroidery sewing machine M2 with reference to the block diagram in FIG. 15.

A control unit 50 that controls the embroidery sewing machine M2 is configured by a microcomputer including a CPU 51, a ROM 52, a RAM 53 and an electrically programmable nonvolatile flash memory (F/M) 54. The control unit 50 has connected thereto a start/stop switch 55; a timing signal generator 56 that detects a rotational position of the sewing machine main shaft; the image sensor 44; and the operation panel 43. The control unit 50 also has connected thereto a drive circuit 62 for the sewing machine motor 57; a drive circuit 63 for the needle-bar changing motor 58; a drive circuit 64 for the thread cutting motor 59 that drives the thread cut mechanism; a drive circuit 65 for the X-shaft drive motor 60 provided in the carriage drive mechanism and the drive circuit 66 for the Y-shaft drive motor 61 respectively.

The ROM 52 has preinstalled therein a drive control program for controlling motors 57 to 61 for executing embroidery sewing, plurality types of sewing data, and a control program for a later described baseline-trace sewing control. The RAM 53 functions as sewing data memory that stores sewing data to be used for a sewing operation and also as memory for various purposes as required.

The flash memory 54 stores a needle bar table T4 indicated in FIG. 16. The needle bar table T4 associates a color code (such as red, orange, and yellow) of a thread color (baseline color) with a needle-bar number (such as 1, 2, and 3) that designates six needle bars 40 contained in the needle bar case 35*a*. The thread color associated with the needle-bar number can be changed to a given color from the operation panel 43.

Furthermore, the flash memory 54 stores data of a baseline-width table T5 indicated in FIG. 17. The baseline-width table T5 associates embroidery stitch data (such as running stitch, satin stitch and fill stitch) with a baseline width (such as [0 to 1.0], [1.1 to 5.0], [5.1 and beyond]).

Figure 18:
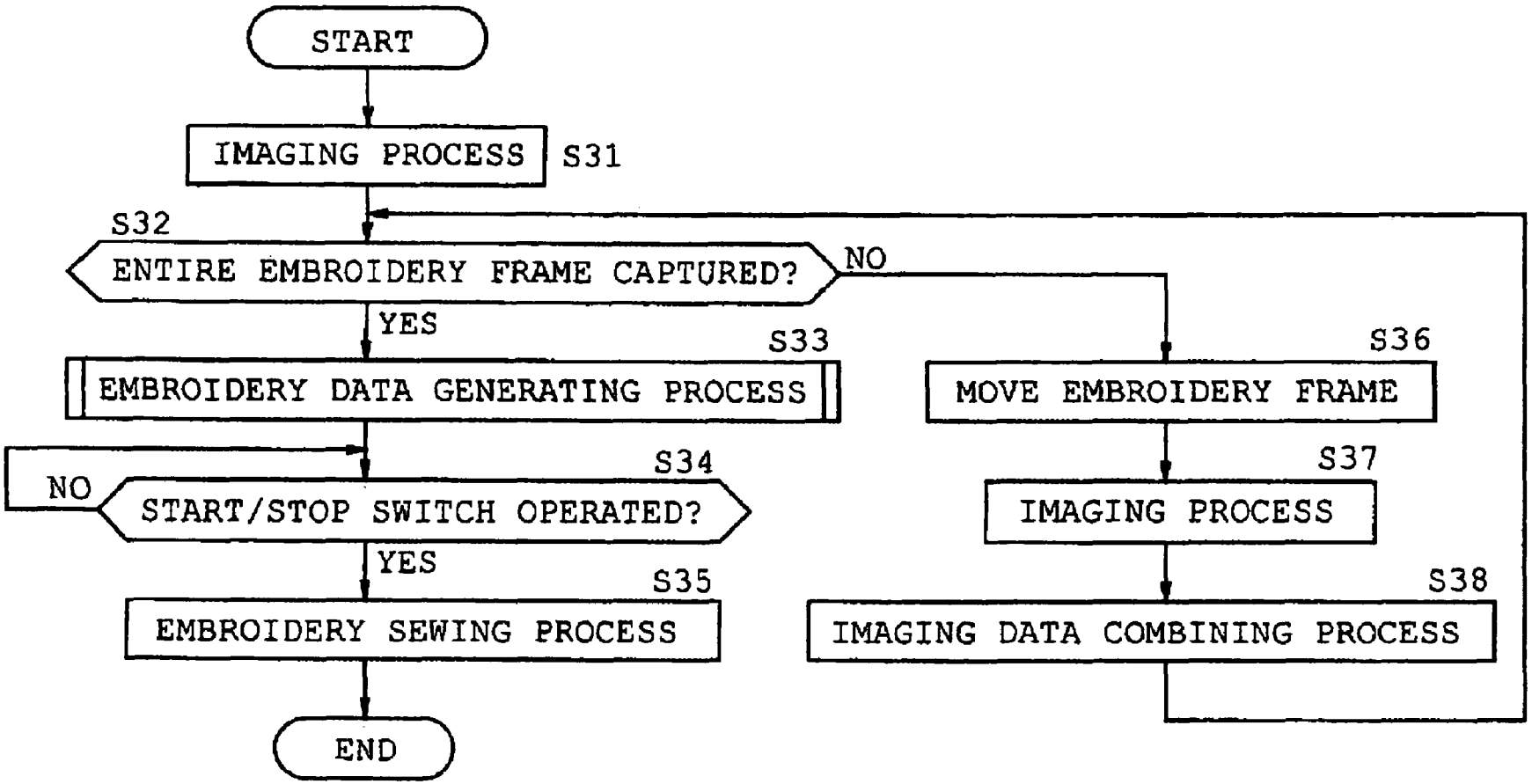
FIG. 18 is a flowchart of a baseline trace sewing control.

Next, a description will be given on the baseline-trace sewing control for embroidery patterns executed by the control unit 50 of the embroidery sewing machine M2 based on the flowchart of FIGS. 18 and 19. The reference symbol Si (i=31, 32, 33 . . . ) indicate each step number.

The control unit 50 starts the control when power is supplied to the embroidery sewing machine M2. First, the image sensor 44 executes an imaging process (step 31). In the imaging process, the control unit 50 captures the image of the embroidery frame 46 after moving the embroidery frame 46 to a predetermined imaging position, which is a position furthest to the pillar 32 side, for example. By capturing the image of the embroidery frame 46 after moving the embroidery frame 46 to the imaging position, the embroidery frame 46 in its entirety can be captured in one go. When the imaging process is terminated, the control unit 50 proceeds to step S32 and judges whether or not the entire embroidery frame 46 has been captured in the captured image data. In case the entire embroidery frame 46 has not been captured (NO), the control unit 50 proceeds to step S36 and moves the embroidery frame 46 forward by a predetermined distance. Then, after executing the imaging process in step S37, the control unit 50 proceeds to step S38 and executes a combining process of the image data. In the combining process, the control unit 50 combines the image data captured in step S37 and the image data captured in step S31.

Figure 19:
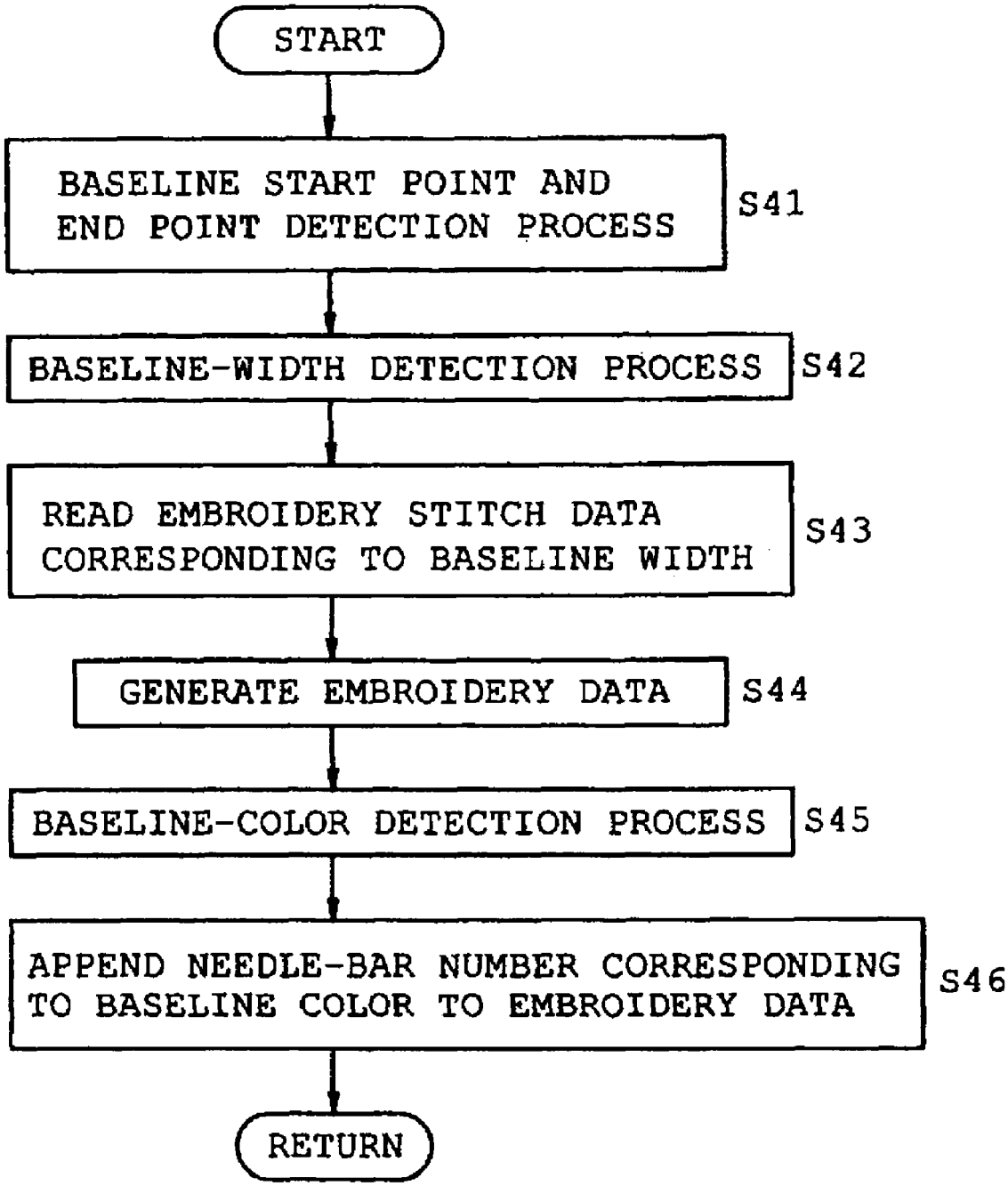
FIG. 19 is a flowchart of an embroidery data generating process.

In the above described step S32, in case the image of the entire embroidery frame 46 has been captured (YES), the control unit 50 proceeds to step S33 and executes an embroidery data generating process (refer to FIG. 19). In the embroidery data generating process, the control unit 50 generates embroidery data based on the baseline 68 drawn on the surface of the workpiece cloth W2 retained by the embroidery frame 46.

Referring to FIG. 19, when the control unit 50 starts the embroidery data generating process, first, a detection process that detects a start point and an end point of the baseline 68 is executed (step S41). In the detection process, the control unit 50 executes a binarizing process and an outline extraction process of the image data and detects the embroidery frame 46 and the baseline 68 present within the embroidery frame 46 respectively. Then, the control unit 50 detects a terminal end of the baseline 68 close to the pillar 32 side for example as a start point 68*s* (refer to FIG. 20) and detects a terminal end that traces the baseline 68 from the start point 68*s* as the end point 68*e* (refer to FIG. 20).

Next, the control unit 50 proceeds to step S42 and executes a baseline-width detection process. In the baseline-width detection process, the control unit 50 detects the baseline width of the baseline 68 drawn on the workpiece cloth W2 based on the image data. Next, the control unit 50 reads the embroidery stitch data (step S43) corresponding to the detected baseline width based on the baseline width table T5. Then, the control unit 50 proceeds to step S44 and generates embroidery data corresponding to the entire baseline 68 extending from the start point 68*s* to the end point 68*e*.

Next, the control unit 50 proceeds to step S45 and executes a baseline-color detection process. In the baseline-color detection process, the control unit 50 detects the baseline color of the baseline 68 drawn on the workpiece cloth W2 based on the image data. Next, the control unit 50 proceeds to step S46 and reads the needle-bar number corresponding to the detected baseline color based on the needle bar table T4. Then, the needle-bar number read is appended to a position (address) storing the baseline color among the embroidery data generated in step S44. After terminating the embroidery data generating process, the control unit 50 proceeds to step S34 of the baseline-trace sewing control (refer to FIG. 18). In the above described step S46, the control unit 50 may append the color code instead of the needle-bar number.

In step S34, the control unit 50 displays a message that notifies the user of the completion of the embroidery data generating process on the display 43*a* of the operation panel 43. Then, the control unit 50 judges whether or not the user has operated the start/stop switch 55. If the start/stop switch 55 has been operated by the user (YES), the control unit 50 proceeds to step S35 and executes the embroidery sewing process based on the embroidery data ultimately generated in the above described step S46. In the embroidery sewing process, the control unit 50 changes the needle bar 40 by driving the needle bar change motor 58 based on the needle-bar number contained in the embroidery data. Thus, the thread to be used for embroidery sewing is changed to the color identical to the baseline color.

Next, a description will be given on the operation of the baseline-trace sewing control.

Figure 20:
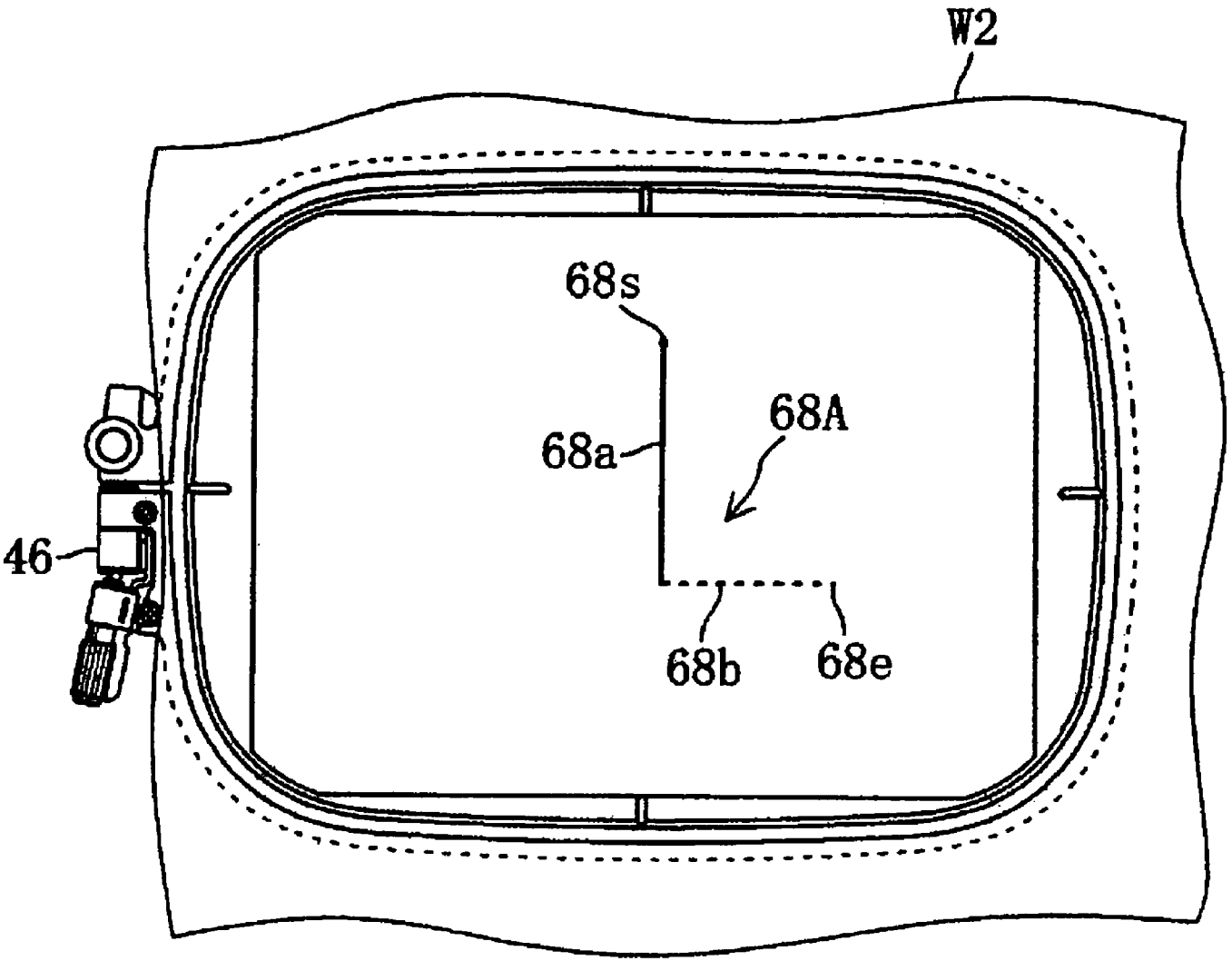
FIG. 20 is a plan view of a workpiece cloth having a thin baseline drawn thereon and an embroidery frame.

FIG. 20 shows a baseline 68A drawn by the user with a chalk pen erasable by an eraser on the surface of the workpiece cloth W2 retained by the embroidery frame 46. In this case, a baseline 68A is composed of a first baseline 68*a* in "red" and having a line width of "0.6 mm"; and a second baseline 68*b* in "green" and having a line width of "0.6 mm" for example; and is generally drawn as an L-shape. The embroidery frame 46 illustrated in FIGS. 20 to 25 exemplify slight variations of the embroidery frame 46 illustrated in FIG. 14. Also, the portion being attached to the aforementioned frame holder 91 have been omitted; however the embroidery frames 46 are attached attachably/detachably to the frame holder 91.

When the user attaches the embroidery frame 46 retaining the workpiece cloth W2 to the frame holder 91, the image of the baseline 68A is captured by the image sensor 44. Next, a start point 68*s* and an end point 68*e* of the baseline 68A are detected based on the captured image data as well as the baseline width and the baseline color. Then, the embroidery stitch data corresponding to the detected baseline width is read and the needle-bar number corresponding to the baseline color is appended to the embroidery stitch data. Thus, the embroidery data containing all information for baseline 68A is generated.

Figure 21:
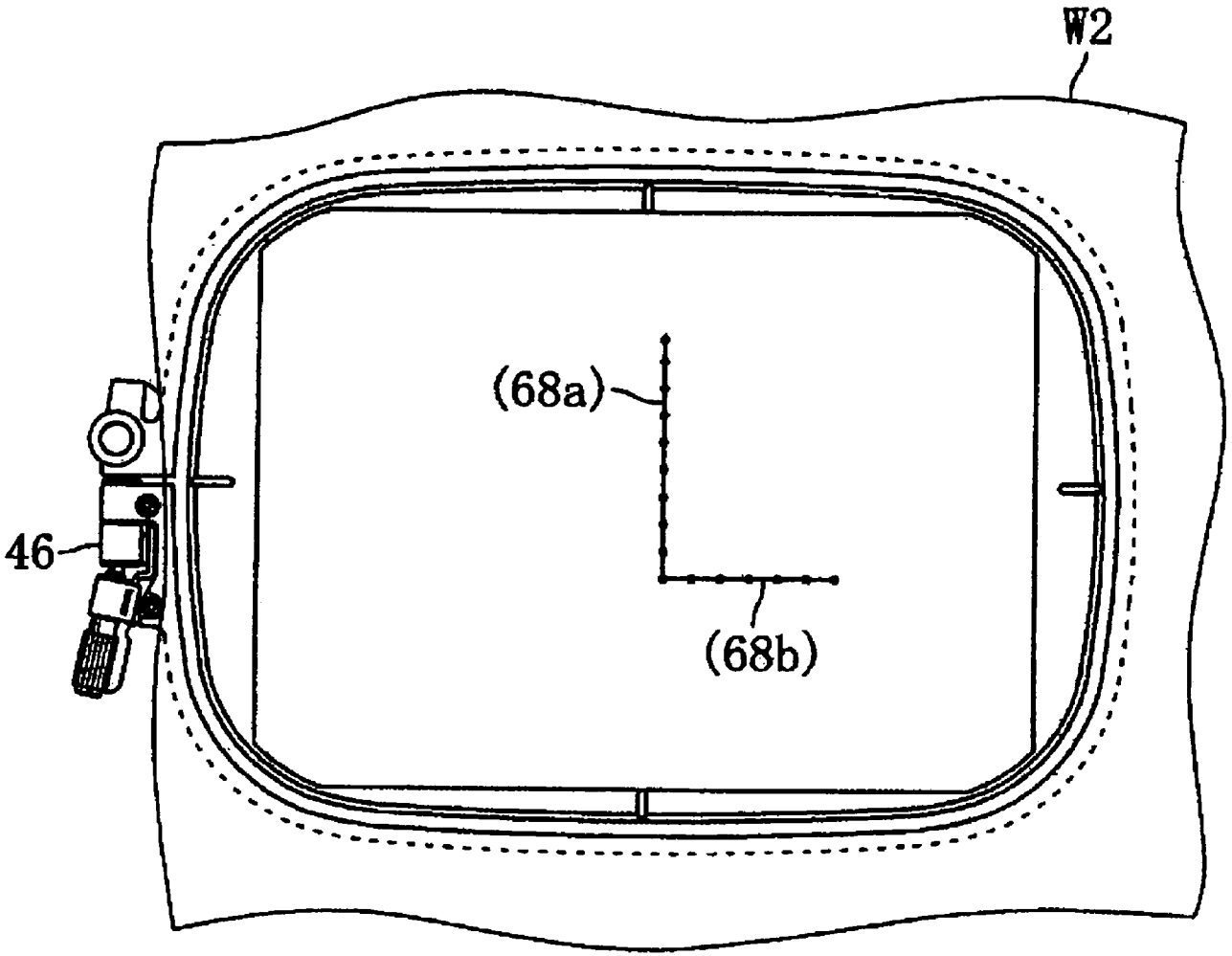
FIG. 21 corresponds to FIG. 20 and has embroidery stitches formed along the thin baseline.

When the start/stop switch 55 is operated, the X-shaft drive motor 60 and the Y-shaft drive motor 61 of the carriage drive mechanisms 93 and 94 are controlled respectively based on the embroidery data corresponding to the baseline width and the baseline color of the baseline 68A. Thus, the embroidery frame 46 is moved and the start point 68*s* is moved to a sewing start position. Next, a needle bar 40 having a red needle thread set thereto is selected and driven while the embroidery frame 46 is moved so as to execute a sewing operation along a first baseline 68*a* in "red". Next, when reaching the start point of a second baseline 68*b* in "green", the red needle thread is cut by the thread cut mechanism and the embroidery sewing machine M2 is tentatively stopped. Then, a needle bar 40 having a green needle thread set thereto is selected and the embroidery frame 46 is moved so as to sew along the "green" second baseline 68*b*. Next, when reaching the end point of the "green" second baseline 68*b*, the red needle thread is cut by the thread cut mechanism and the embroidery sewing machine M2 is tentatively stopped. Thus, embroidery stitches extending along the baseline 68A from the start point 68*s* to the end point 68*e* are formed on the workpiece cloth W2. As a result, as shown in FIG. 21, a running stitch is formed in "red" thread along the first baseline 68*a* and a running stitch is formed in "green" thread along the second baseline 68*b*.

Figure 22:
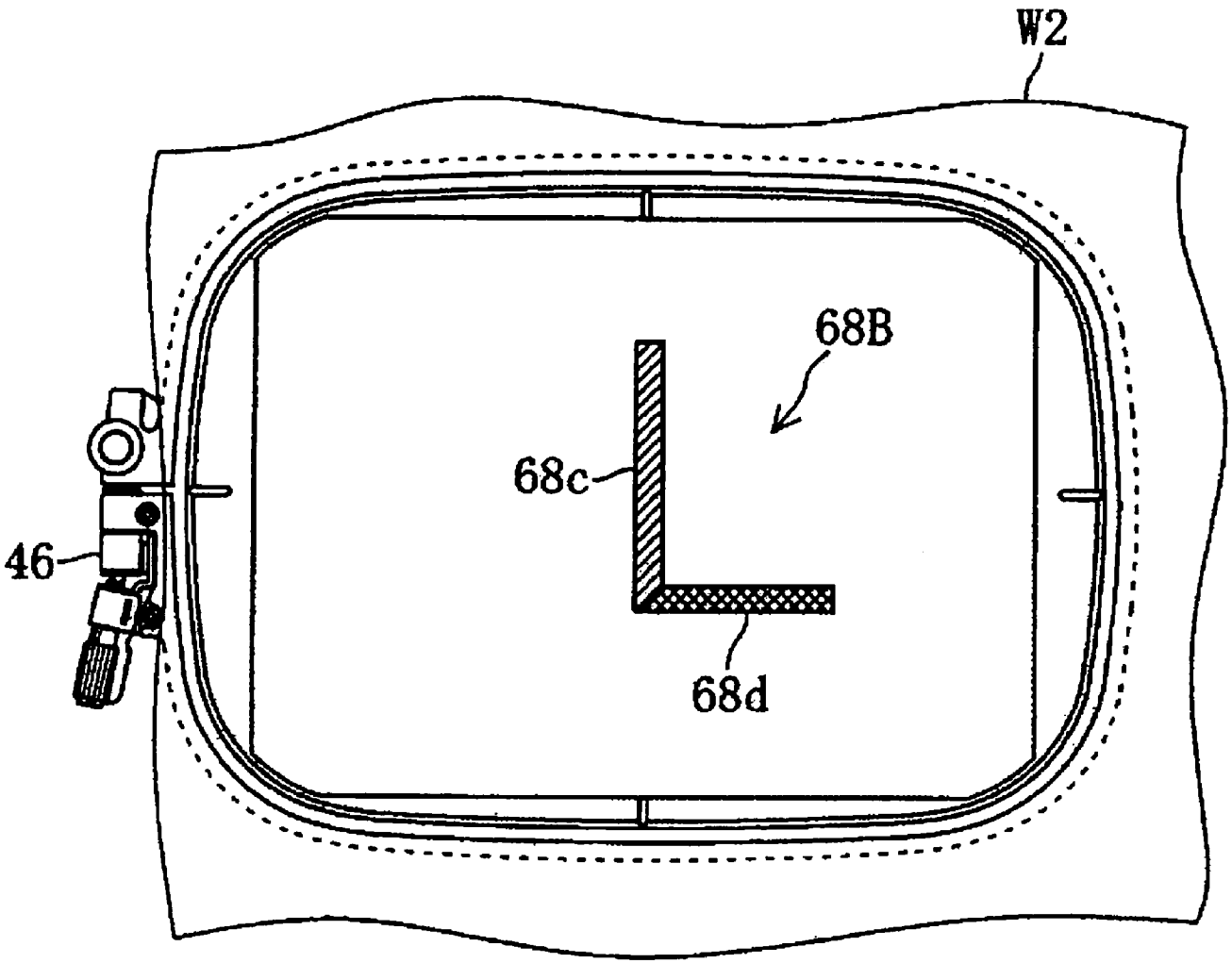
FIG. 22 is a plan view of a workpiece cloth having a medium-thickness baseline drawn thereon and the embroidery frame.
Figure 23:
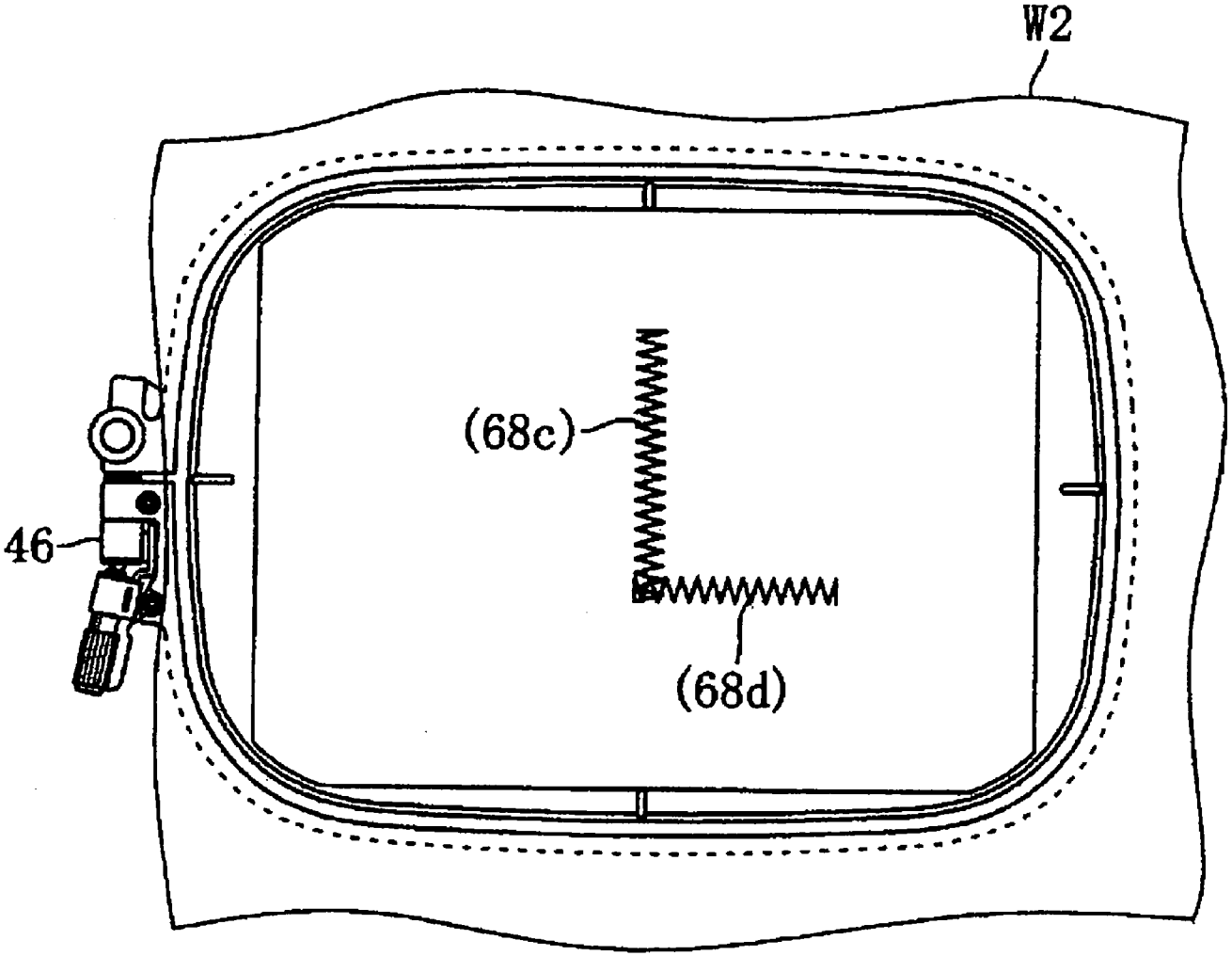
FIG. 23 corresponds to FIG. 22 and has an embroidery stitch formed along the medium-thickness baseline.

FIG. 22 shows a baseline 68B drawn by the user with a chalk pen erasable by an eraser on the surface of the workpiece cloth W2 retained by the embroidery frame 46. In this case, a baseline 68B is composed of a first baseline 68*c* in "yellow" and having a line width of "2.0 mm"; and a second baseline 68*d* in "blue" and having a line width of "2.0 mm" for example; and is generally drawn as an L-shape. In case such baseline 68B is drawn, as shown in FIG. 23, a satin stitch in "yellow" thread is formed along the first baseline 68*c* and a satin stitch in "blue" thread is formed along the second baseline 68*d*.

Figure 24:
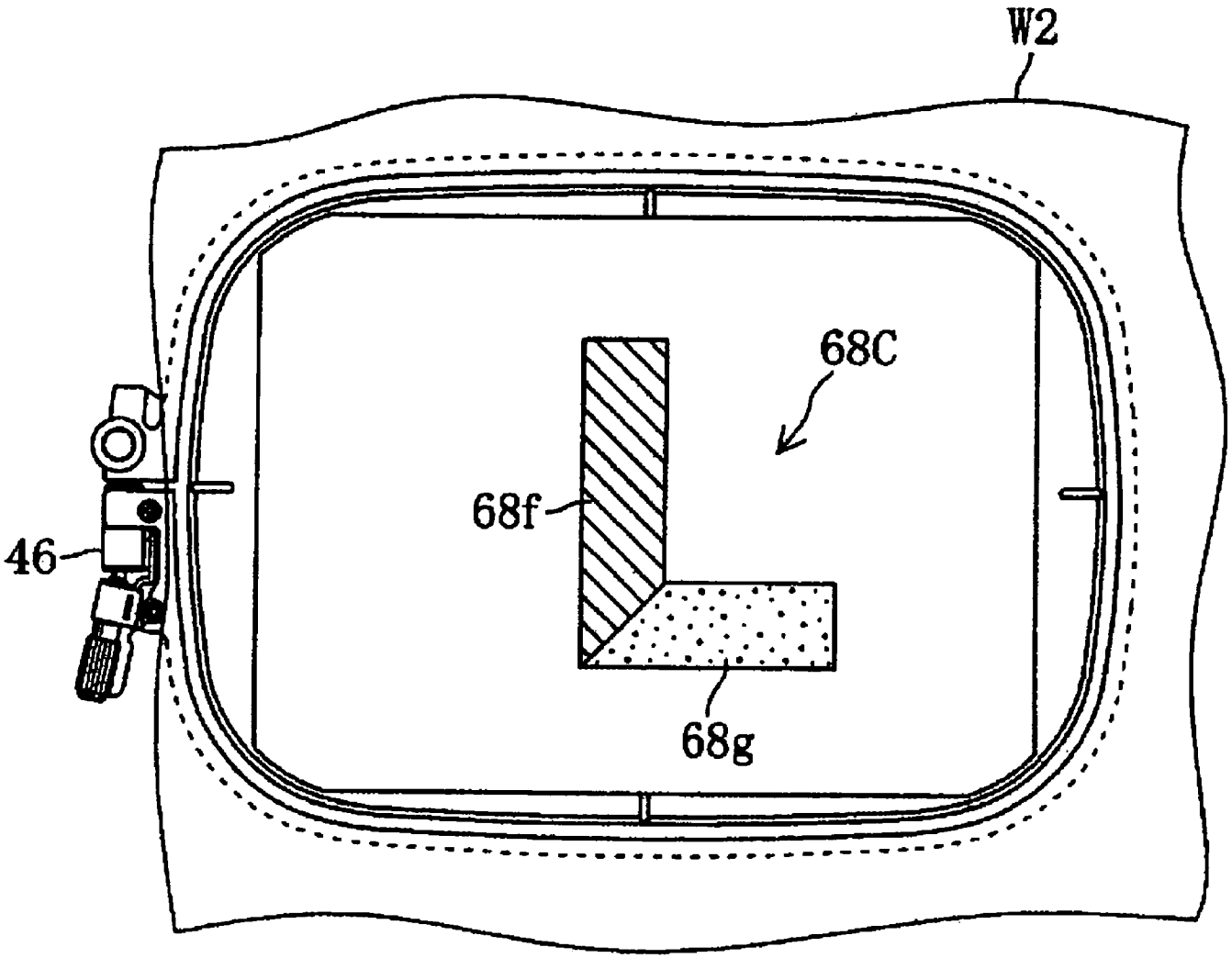
FIG. 24 is a plan view of a workpiece cloth having a large-thickness baseline drawn thereon and the embroidery frame.
Figure 25:
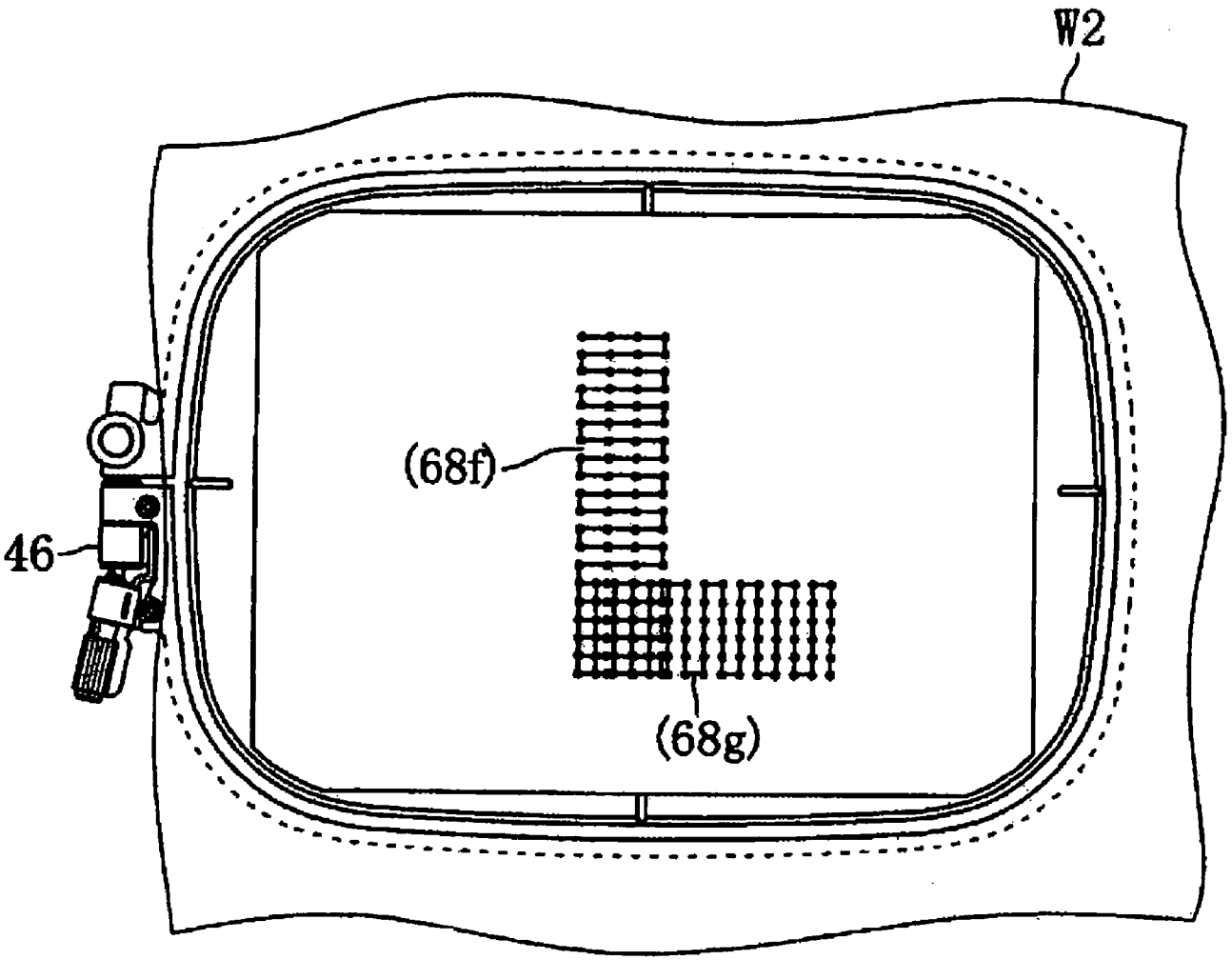
FIG. 25 corresponds to FIG. 24 and has embroidery stitches formed along the large-thickness baseline.

FIG. 24 shows a baseline 68C drawn by the user with a chalk pen erasable by an eraser on the surface of the workpiece cloth W2 retained by the embroidery frame 46. In this case, a baseline 68C is composed of a first baseline 68*f* in "orange" and having a line width of "5.5 mm"; and a second baseline 68*g* in "purple" and having a line width of "5.5 mm" for example; and is generally drawn as an L-shape. In case such baseline 68C is drawn, as shown in FIG. 25, a fill stitch in "orange" thread is formed along the first baseline 68*f* and a fill stitch in "purple" thread is formed along the second baseline 68*g*.

As described above, according to the present embodiment, the embroidery sewing machine M2 capable of embroidery sewing includes a carriage 37 to which an embroidery frame 46 retaining a workpiece cloth W2 is attachably/detachably attached; a carriage drive mechanism that moves the carriage 37 independently in an X-direction and a Y-direction perpendicular to the other; an image sensor 44; and a control unit 50. Under such configuration, the carriage drive mechanism is arranged to be controlled based on the image data captured by the image sensor 44. Thus, in executing a sewing operation, the user is allowed to form embroidery stitches automatically along the baselines 68 by merely drawing various baselines 68 (baselines 68A to 68C for example) on the surface of the workpiece cloth W2.

Thus, even an inexperienced user is allowed to readily create sewing products including abundant varieties of embroidery stitches such as satin stitches and fill stitches just like an experienced sewer by merely drawing various baselines 68 on a surface of the workpiece cloth W2.

Also, a plurality of needle bars 40; a needle-bar switch mechanism 35 that selectively switches the plurality of needle bars 40; a needle bar table T4 storing a mapping of the plurality of needle bars 40 and the thread colors of the needle threads set to the needle bars 40; a baseline-color detection step (step S45) that detects the baseline color of the baseline 68 based on the image data of the baseline 68 captured by the image sensor 44; and a needle-bar determining step (step S46) that determines the needle bar 40 based on the baseline color of the baseline 68 detected by the baseline-color detection step and data stored in the needle bar table T4 have been provided. Under such configuration, the control unit 50 controls the needle-bar switch mechanism 35 to make a switch to the needle bar 40 determined in the needle-bar determining step. Thus, a sewing operation can be executed by using a needle bar 40 associated with a predetermined baseline color and the needle thread of the thread color corresponding to the baseline color for each baseline in different baseline color by merely requiring the user to draw various baselines 68 in different baseline colors on the surface of the workpiece cloth W2.

Thus, even an inexperienced user is allowed to readily create sewing products including abundant varieties of needle thread colors just like an experienced sewer by merely drawing various baselines 68 on the surface of the workpiece cloth W2 while changing the baseline color as required.

Also, a baseline-width detection step (step S42) that detects the baseline-width of the baseline 68 based on the image data of the baseline 68 captured by the image sensor 44 have been introduced as well as a provision of a baseline-width table T5 that stores mapping of plurality types of baseline-width to their respective corresponding types of embroidery stitch data. The control unit 50 reads the embroidery stitch data corresponding to the baseline width detected in the baseline-width detection step from the baseline-width table T5 and controls the carriage drive mechanism based on the embroidery stitch data. Thus, various embroidery stitches associated with predetermined baseline widths can be sewn for each baseline 68 having different baseline width by merely requiring the user to draw various baselines 68 having different baseline widths on the surface of the workpiece cloth W2.

Thus, even an inexperienced user is allowed to readily create embroidery sewing products including abundant varieties of embroidery patterns just like an experienced sewer by merely drawing various baselines 68 on the surface of the workpiece cloth W2 while changing the baseline width as required.

The present disclosure is not limited to each of the above described embodiments but may be modified or expanded as follows.

In case, the baseline 68 is drawn as a closed loop, the portion closest to the original point position of the embroidery frame 46 among the positions within the baseline 68 may be set as the start point.

In case the embroidery frame 46 is too large in size to allow its entire image to be captured within a single screen of the image sensor 44, the image sensor 44 may employ a wide-angle lens or employ a zooming mechanism.

The image sensors 9 and 44 are not limited to a CCD image sensor but may employ CMOS image sensor or other various imaging elements.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine, comprising:

a needle-swing mechanism that swings a needle bar;

a cloth-feed mechanism that feeds a workpiece cloth by a feed dog;

an imaging unit that captures an image of a baseline drawn on a surface of the workpiece cloth;

a baseline-color detection portion that detects a baseline color of the baseline based on an image data of the baseline captured by the imaging unit;

a first storage portion that stores a mapping of a plurality of baseline colors to stitch data of a plurality of normal patterns; and a control portion that forms normal pattern stitches along the baseline by reading stitch data corresponding to the baseline color detected by the baseline-color detection portion from the first storage portion and controlling the needle-swing mechanism and the cloth-feed mechanism based on the stitch data read.

2. The sewing machine of claim 1, further comprising a baseline-width detection portion that detects a baseline width of the baseline based on the image data of the baseline captured by the imaging unit, and a second storage portion that stores a mapping of each of a plurality of baseline widths to needle-swing amount data of the needle bar and cloth-feed amount data of the feed dog, wherein the control portion controls the needle-swing mechanism and the cloth-feed mechanism by reading the needle-swing amount data and the cloth-feed amount data corresponding to the baseline width detected by the baseline- detection portion from the second data storage portion.

3. The sewing machine of claim 1, wherein the imaging unit is composed of a CCD image sensor or a CMOS image sensor.

4. A sewing machine capable of embroidery sewing, comprising:

a carriage to which an embroidery frame retaining a workpiece cloth is attachably/detachably attached;

a carriage drive mechanism that drives the carriage independently in an X-direction and a Y-direction perpendicular to the other respectively;

an imaging unit that captures an image of a baseline drawn on a surface of the workpiece cloth;

a plurality of needle bars;

a needle-bar switch mechanism that selectively switches the plurality of needle bars;

a first storage portion that stores a mapping of the plurality of needle bars to thread colors of needle threads set to the needle bars;

a baseline-color detection portion that detects a baseline color of the baseline based on the image data of the baseline captured by the imaging unit;

a needle-bar determining portion that determines a needle bar to be used for sewing based on the baseline color of the baseline detected by the baseline-color detection portion and data stored in the first storage portion;

a baseline-width detection portion that detects a baseline width of the baseline based on the image data of the baseline captured by the imaging unit;

a second storage portion that stores a mapping of each of a plurality of baseline widths to each type of embroidery stitch data; and a control portion that controls the carriage drive mechanism so as to form an embroidery stitch along the baseline based on the image data of the baseline captured by the imaging unit;

wherein the control portion controls the needle-bar switch mechanism so as to make a switch to the needle bar determined in the needle-bar determining portion; and the control portion reads embroidery stitch data corresponding to a baseline width detected by the baseline-width detection portion from the second data storage portion and controls the carriage drive mechanism based on the embroidery stitch data.

5. The sewing machine of claim 4, wherein the imaging unit is composed of a CCD image sensor or a CMOS image sensor.

* * * * *